US010962181B2

(12) United States Patent
Sonneman et al.

(10) Patent No.: US 10,962,181 B2
(45) Date of Patent: Mar. 30, 2021

(54) LIGHTING SYSTEM

(71) Applicant: Contemporary Visions, LLC, Larchmont, NY (US)

(72) Inventors: Robert A. Sonneman, Mamaroneck, NY (US); Christian N. Garnett, Mount Kisco, NY (US); Nuno Luis Pires Da Silva, Lisbon (PT); Yang Wang, Scarsdale, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 16/670,430

(22) Filed: Oct. 31, 2019

(65) Prior Publication Data

US 2020/0132262 A1 Apr. 30, 2020

Related U.S. Application Data

(60) Provisional application No. 62/753,165, filed on Oct. 31, 2018.

(51) Int. Cl.
*F21S 2/00* (2016.01)
*F21S 8/06* (2006.01)
(Continued)

(52) U.S. Cl.
CPC ..... *F21S 2/005* (2013.01); *F21S 8/06* (2013.01); *F21V 21/005* (2013.01);
(Continued)

(58) Field of Classification Search
CPC ..... F21S 2/005; F21S 8/06; F21V 21/005; F21V 21/008; F21Y 2103/10; F21Y 2115/10
See application file for complete search history.

(56) References Cited

U.S. PATENT DOCUMENTS

D165,738 S 1/1952 Brochstein
D456,550 S 4/2002 Clodagh
(Continued)

FOREIGN PATENT DOCUMENTS

CN 204986560 U 1/2016
CN 106678594 A 5/2017
(Continued)

OTHER PUBLICATIONS

Sleek Island Chandelier SKU: CH 18256 AL from shadesoflight.com, visited Mar. 29, 2019. (Year: 2019).
(Continued)

*Primary Examiner* — Mary Ellen Bowman
(74) *Attorney, Agent, or Firm* — Gottlieb Rackman & Reisman PC

(57) ABSTRACT

A modular lighting system that includes or more luminaires that can be individually suspended from a surface or connected to each other to form a variety of scalable arrangements that project light downwardly therefrom. The luminaire can includes a housing that has a first and a second sidewall that is spaced from the first sidewall and a light source that is arranged between the first sidewall and the second sidewall. A first connector can be fixed to and delimit a first end of the luminaire and deliver power to the light source and a second connector can be configured to be fixed to and delimit a second end of the luminaire.

19 Claims, 31 Drawing Sheets

(51) Int. Cl.

| | |
|---|---|
| ***F21V 21/008*** | (2006.01) |
| ***F21V 21/005*** | (2006.01) |
| ***F21Y 103/10*** | (2016.01) |
| ***F21Y 115/10*** | (2016.01) |

(52) U.S. Cl.
CPC ..... *F21V 21/008* (2013.01); *F21Y 2103/10* (2016.08); *F21Y 2115/10* (2016.08)

(56) References Cited

U.S. PATENT DOCUMENTS

| | | | | | |
|---|---|---|---|---|---|
| D500,878 | S | | 1/2005 | Lewis et al. | |
| D562,493 | S | | 2/2008 | Chen | |
| D592,794 | S | * | 5/2009 | Chandler | D26/141 |
| D592,795 | S | | 5/2009 | Chandler | |
| D622,892 | S | | 8/2010 | Nicholas | |
| D626,278 | S | | 10/2010 | Sabernig | |
| D655,441 | S | | 3/2012 | Sabernig | |
| D684,299 | S | | 6/2013 | Liang et al. | |
| D700,989 | S | | 3/2014 | Rampolla et al. | |
| D759,876 | S | | 6/2016 | Blum et al. | |
| D825,819 | S | | 8/2018 | Sonneman | |
| 2008/0068839 | A1 | * | 3/2008 | Matheson | F21V 29/81 362/249.07 |
| 2009/0207602 | A1 | * | 8/2009 | Reed | F21S 2/005 362/225 |
| 2015/0300617 | A1 | * | 10/2015 | Katona | F21V 23/001 362/147 |
| 2016/0201863 | A1 | * | 7/2016 | Kwast | H02G 3/083 362/404 |
| 2017/0030561 | A1 | | 2/2017 | Dix et al. | |
| 2019/0162369 | A1 | * | 5/2019 | Sonneman | F21S 2/00 |

FOREIGN PATENT DOCUMENTS

| | | | |
|---|---|---|---|
| GB | 2502777 | A | 12/2013 |
| TW | 201416604 | A | 5/2014 |

OTHER PUBLICATIONS

ISA/US, PCT International Search Report and Written Opinion dated Feb. 24, 2020 issued in PCT International Application No. PCT/US2019/059185.

USPTO, Notice of Allowance and PTO892-Form dated Apr. 11, 2019 issued in corresponding U.S. Appl. No. 29/674,250 dated Aug. 27, 2019.

* cited by examiner

LIGHTING SYSTEM

CROSS-REFERENCE TO RELATED APPLICATION

This application claims priority to U.S. Provisional Patent Application No. 62/753,165, filed on Oct. 31, 2018, the contents of each are incorporated herein by reference in their entirety.

FIELD OF THE INVENTION

This invention relates generally to a luminaire and more specifically to a modular lighting system that is configured to be hung from a surface (e.g., a ceiling or similar structure) and that is configured to emit light therefrom.

BACKGROUND OF THE INVENTION

Known modular lighting system come in various shapes and configurations ranging from a single lighting fixture to multiple lighting fixtures that are affixable to a surface (e.g., ceiling, wall or similar structure). However, such modular lighting systems do not allow for seamless and continuous electro-mechanical connectivity between luminaires that can be configured to be an array of possible arrangements.

SUMMARY OF THE INVENTION

In general, the present disclosure is directed to a modular lighting system of linearly extending luminaires that can be individually suspended from a surface or can be connected to each other to form a variety of scalable arrangements that project light downwardly therefrom. For example, when combined, the luminaires can form stars, hexagons, honeycombs, linearly extending lighting systems, and other abstract arrangements. The downward direction of the light, through the optical acrylic diffusers, provides distributed illumination when suspended high within a space or directed task illumination when suspended low over a work surface.

According to an exemplary embodiment, the present disclosure is directed to a lighting system that comprises a luminaire that includes a housing that has a first sidewall, a second sidewall that is spaced from the first sidewall and a light source arranged between the first sidewall and the second sidewall. A first connector that is configured to be fixed to and delimit a first end of the luminaire and deliver power to the light source and a second connector that is configured to be fixed to and delimit a second end of the luminaire.

The luminaire can include a top plate that is arranged between the first sidewall and the second sidewall and a printed circuit board that is fixed to the top plate, and least one fastener can be configured to fix the printed circuit board to the top plate and transfer electrical current from the top plate to the circuit board.

The light source can be a plurality of light-emitting diodes that are fixed to the printed circuit board.

The luminaire can further include a diffuser that is spaced from the top plate and through which light from the light source projects.

Each of the first sidewall and the second sidewall can include a plurality of rails, openings and grooves that are configured to accommodate and aid in securing elements of the lighting system therein.

The lighting system can further include first bracket that can have a first leg, a second leg and a base that extends between the legs that is configured to be arranged at each end of the luminaire and a second bracket that can include a housing and a plug fixed to the opening that is configured to be arranged at each end of the luminaire in contact with the first bracket.

The first connector and the second connector can be one of an end connector that is configured to delimit the lighting system, an inline connector that is configured to connect two of the luminaires to each other, a corner connector that is configured to connect two of the luminaires to each other at an angle and a three-way connector that is configured to connect three of the luminaires to each other.

At least one of the first connector and the second connector can be configured to transfer power to the luminaire.

The lighting system can further include a cable that extends from a power source and is fixed within one of the first connector and the second connector. The cable can include an inner wire over which positive current is transferred and an outer wire over which a negative current is transferred. The negative current can be in contact with at least one of the first connector and the second connector and over the at least one of the first connector and the second connector negative current travels and the positive current is in connect with at least one pin that extends from the at least one of the first connector and the second connector.

In an assembled state, the at least one pin can be arranged within the plug which in turn is in connect with a wire to transfer positive current therefrom.

The wire can be is split into a first wire and a second wire with the first wire segment that is fixed to the printed circuit board to transfer positive current to the light source and a second wire segment that bypasses the printed circuit board. The first wire segment can be fixed to a first end of the printed circuit board and a second of the first wire segment can be fixed to a second end of the printed circuit board and extends to reconnect with the second wire segment at a second end of the luminaire.

According to another exemplary embodiment, the present disclosure is directed to a method of assembling a lighting system comprising the steps of providing a luminaire that includes a housing that has a first sidewall, a second sidewall that is spaced from the first sidewall and a light source arranged between the first sidewall and the second sidewall; fixing a first connector to a first end of the luminaire; fixing a second connector to a second end of the luminaire; and providing power through one of the first connector and the second connector to illuminate the light source. The luminaire can include a pin and a plurality of brackets can extend at each end therefrom and the first connector and the second connector can include an opening therein. The method can further comprise the step of arranging the brackets within the openings of the first connector and the second connector and fixing the luminaire to the first connector and the second connector.

The method can further comprise the step of transferring power from one of the first connector and the second connector to the luminaire with negative current transferred through and about the first connector and the second connector and positive current is transferred through the pin of the first connector and the second connector to a wiring system within the luminaire to illuminate the light source.

DETAILED DESCRIPTION OF EMBODIMENTS OF THE INVENTION

Figure 1:
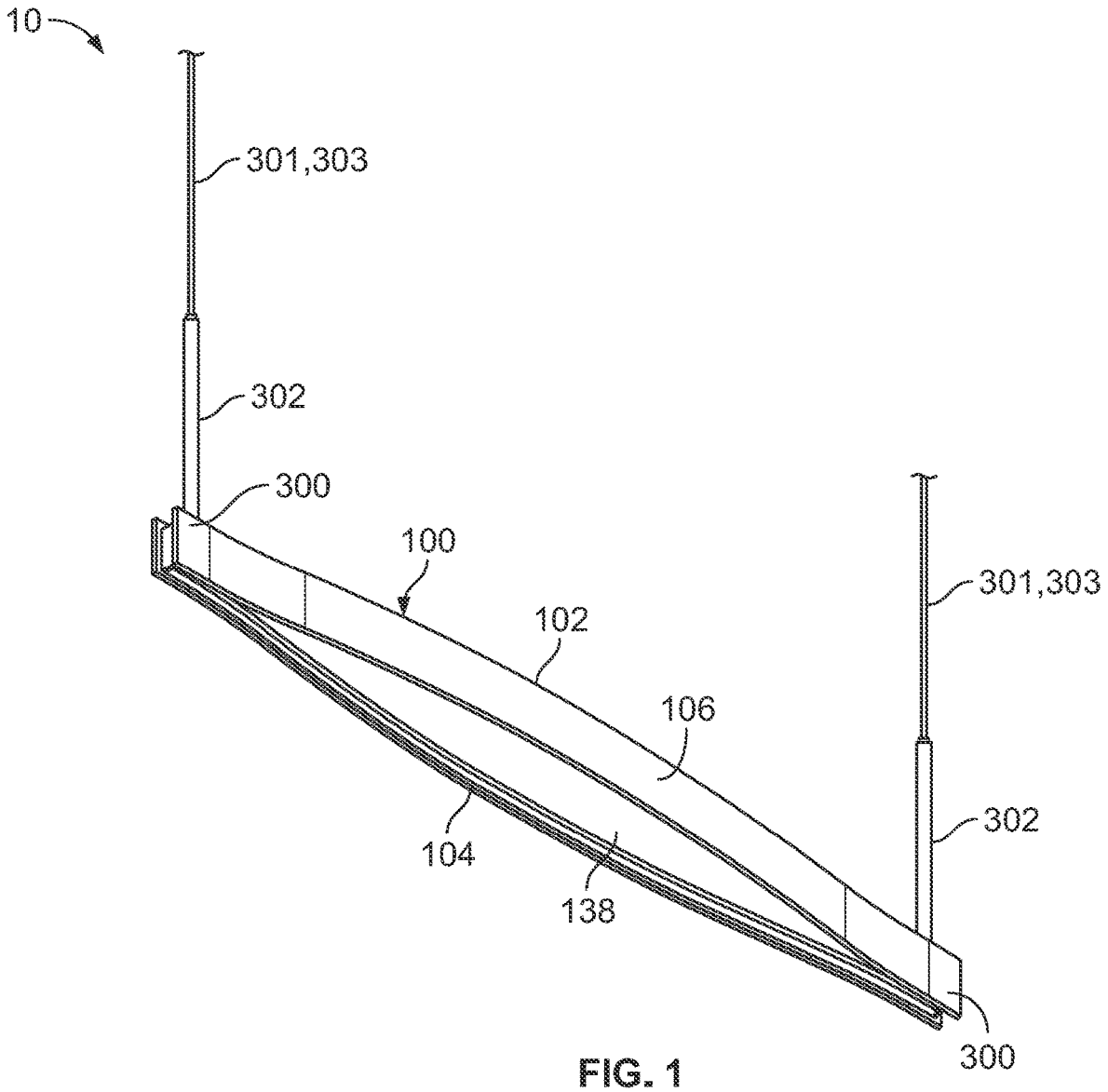
FIGS. 1-6 are various view of a luminaire according to an exemplary embodiment of the present invention.
Figure 2:
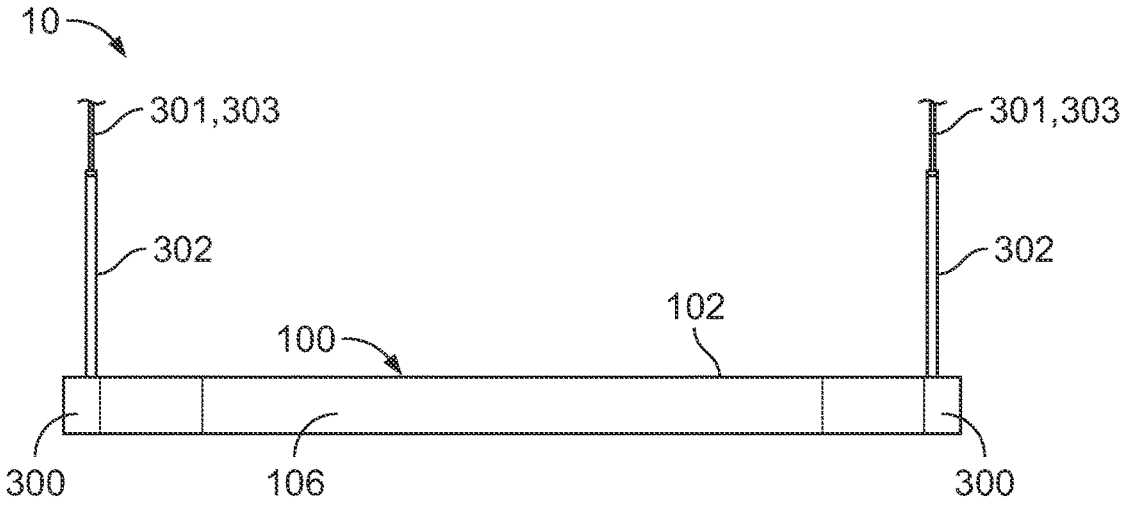
Figure 3:
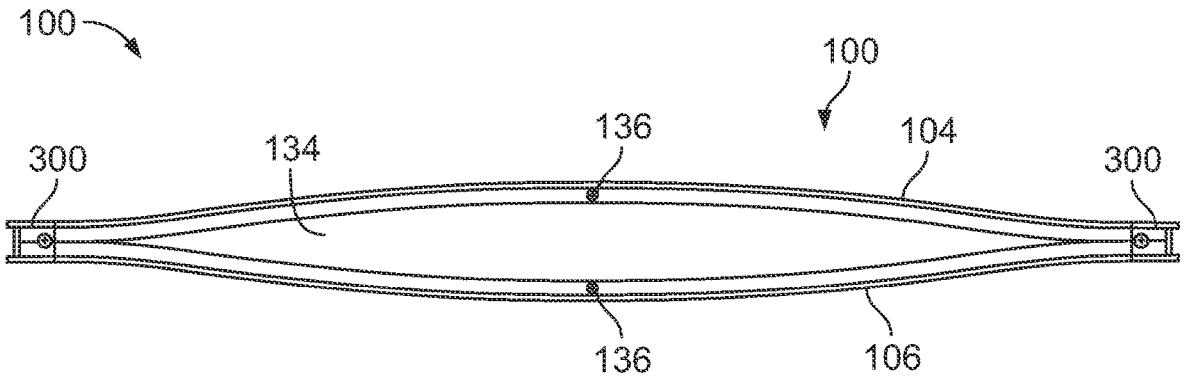
Figure 4:
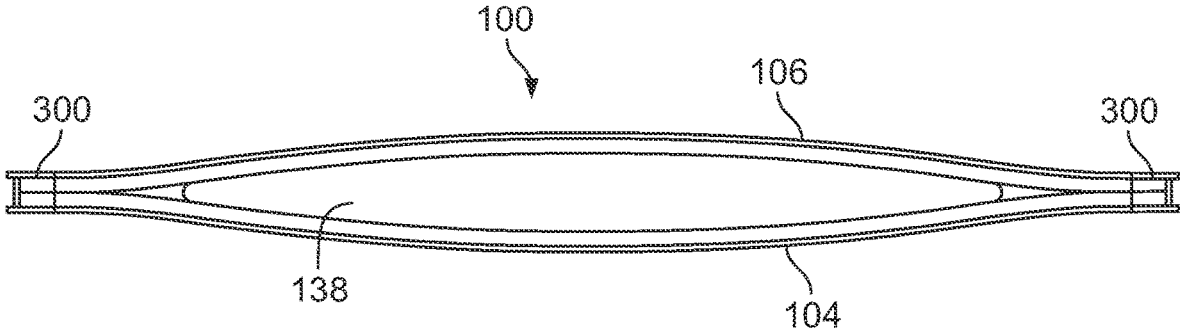
Figure 5:
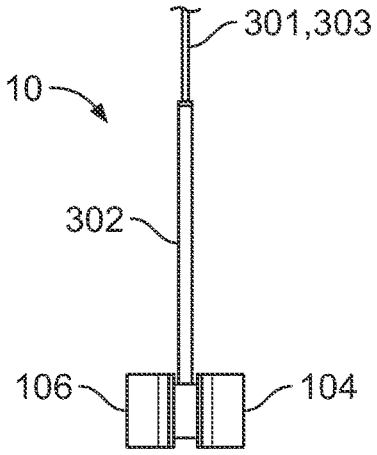
Figure 6:
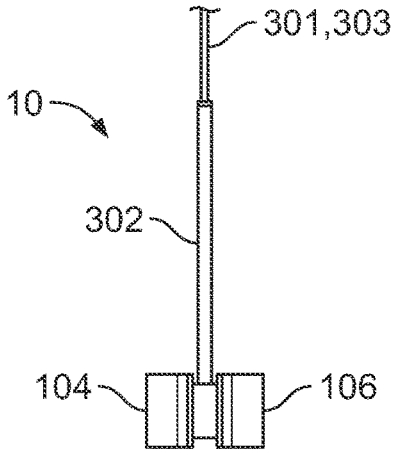

With reference now to the drawings, wherein the same reference number indicates the same element throughout, exemplary embodiments of the modular lighting system of the present invention will be described.

FIGS. 1-6 depict various views of an exemplary embodiment of elements of a modular lighting system 10 of the present invention.

As shown in FIGS. 1-6, the modular lighting system 10 comprises a luminaire 100 that includes a housing 102 that has a first sidewall 104 and a second sidewall 106 which is arranged mirror opposite and spaced from the first sidewall 104. The sidewalls 104, 106 can, for example, be comprised of an extruded metal such as aluminum. It is noted, as will be described in detail below, that the luminaire 100, which is depicted in detail in FIGS. 7-14, is configured to be part of an array of lighting systems, including but not limited to those that are described herein and depicted in the figures.

Figure 7A:
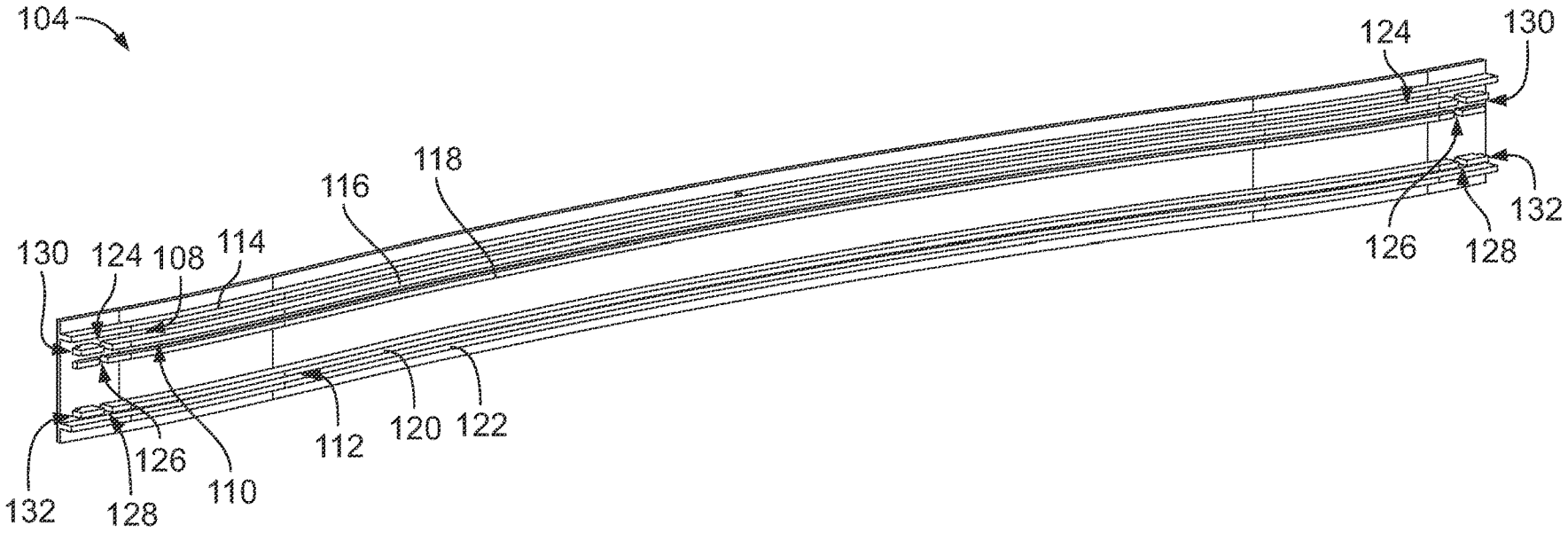
FIGS. 7A and 7B are perspective views of the sidewalls of the luminaire of FIG. 1.

As shown in FIG. 7A, the first sidewall 104 of the luminaire 100 has a plurality of channels, including a first channel 108, a second channel 110 and a third channel 112 that are configured for elements of the luminaire 100 and/or a modular lighting system to be arranged therein. The first channel 108 is formed by a first rail 114 and a second rail 116. The second channel 110 is formed by the second rail 116 and a third rail 118. The third channel 112 is formed by a fourth rail 120 and a fifth rail 122. The second rail 116, the third rail 118 and the fourth rail 120 include spaces or gaps 124, 126, 128, respectively, formed therein near the end of each rail 116, 118, 120, and the second rail 116 and the fourth rail 120 also include grooves 130, 132, respectively, at the ends of the second rail 116 and the fourth rail 120.

Figure 7B:
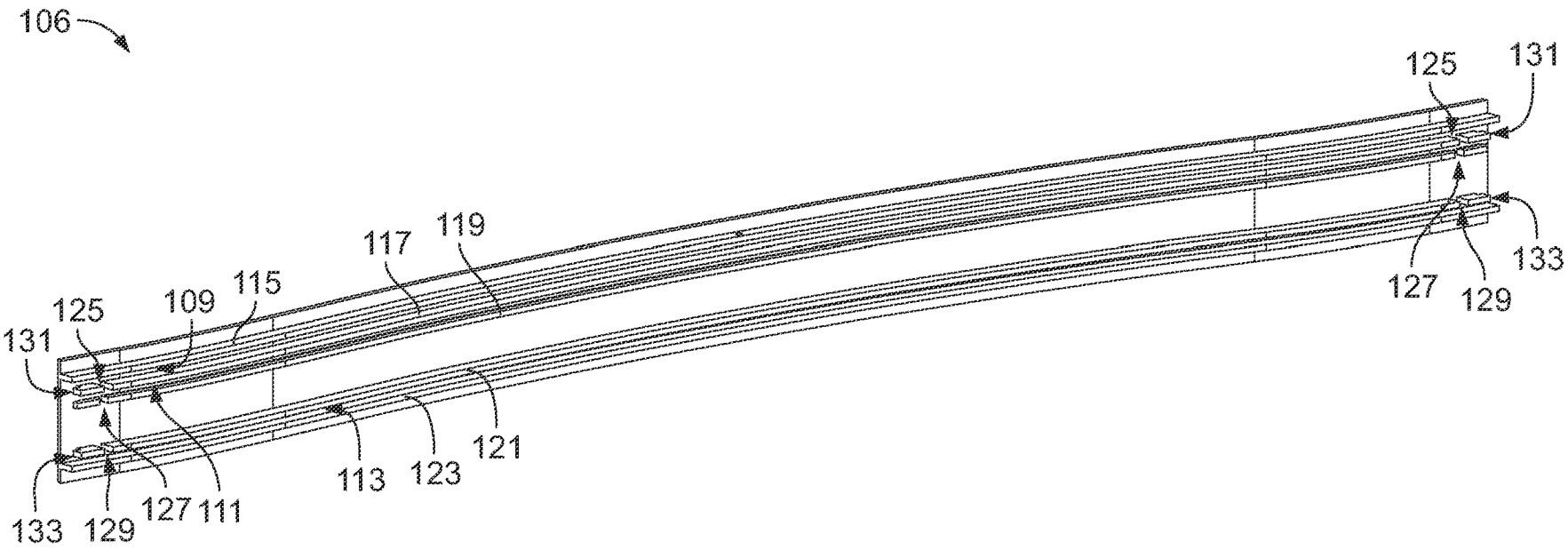
Figure 8:
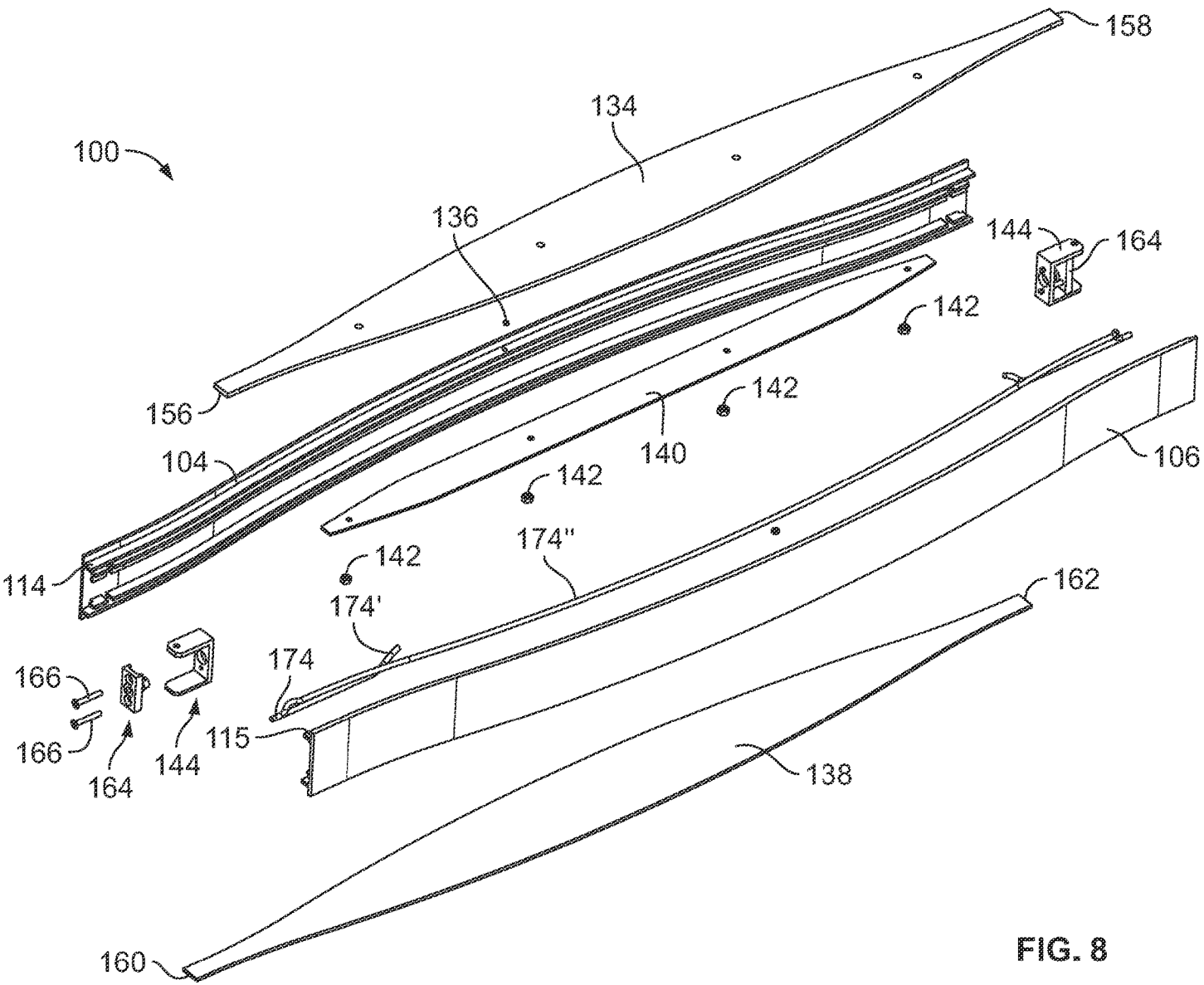
FIG. 8 is an exploded view of the luminaire of FIG. 1.
Figure 9:
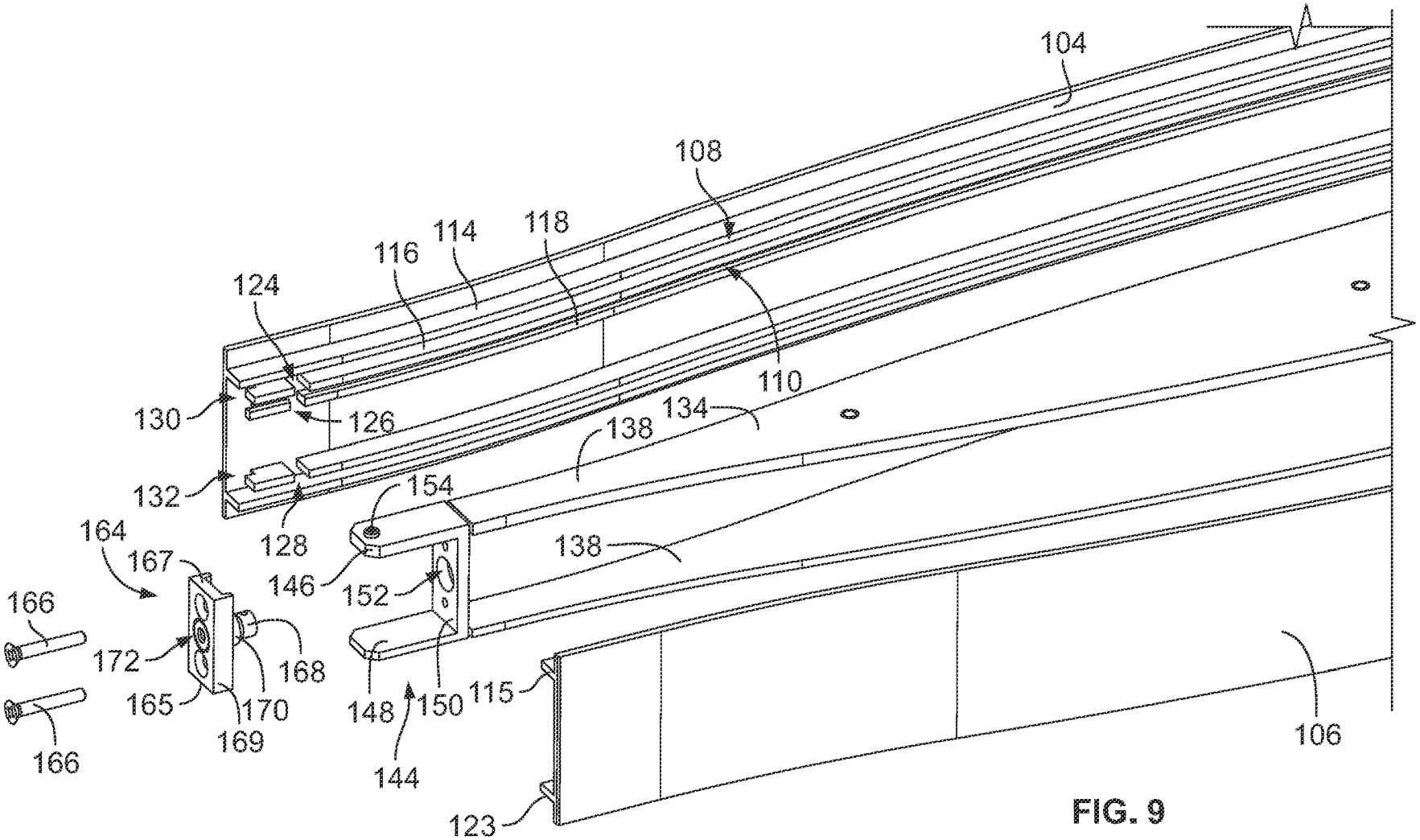
FIG. 9 is a partially exploded sectional view of the luminaire of FIG. 1.

FIG. 7B illustrates the second sidewall 106, which is identical to the first sidewall 104. As shown, the second sidewall 106 includes a plurality of channels, including a first channel 109, a second channel 111 and a third channel 113 that are configured for elements of the luminaire 100 and/or modular lighting system to be arranged therein. The first channel 109 is formed by a first rail 115 and a second rail 117. The second channel 111 is formed by the second rail 117 and a third rail 119. The third channel 113 is formed by a fourth rail 121 and a fifth rail 123. The second rail 117, the third rail 119 and the fourth rail 121 include spaces or gaps 125, 127, 129, respectively, formed therein near the end of each rail 117, 119, 121, and the second rail 117 and the fourth rail 121 also include grooves 131, 133, respectively, at the ends of the second rail 117 and the fourth rail 121.

As depicted, for example, in FIGS. 8-10B, arranged between the sidewalls 104, 106 in the first channel 110, 111 of the first sidewall 104 and the second sidewall 106, respectively, is a top plate 134 and, arranged between the sidewalls 104, 106 in the third channel 114, 115 of the first sidewall 104 and the second wall 106, respectively, is an acrylic diffuser 138 that is spaced from the top plate 134 through which light is emitted. To assist in securing the top plate 134 between the sidewalls 104, 106, as well as provide constant electrical contact for negative current passing over the body 102 of the luminaire 100, fasteners 136 (e.g., set screws), can be used to secure the top plate 134 to the first rail 114, 115 of each sidewalls 104, 106, respectively. The top plate 134 can, for example, be comprised of a metal such as aluminum. However, the plate 134 can be made of other conductive material(s) that are known or may become known.

Figure 10A:
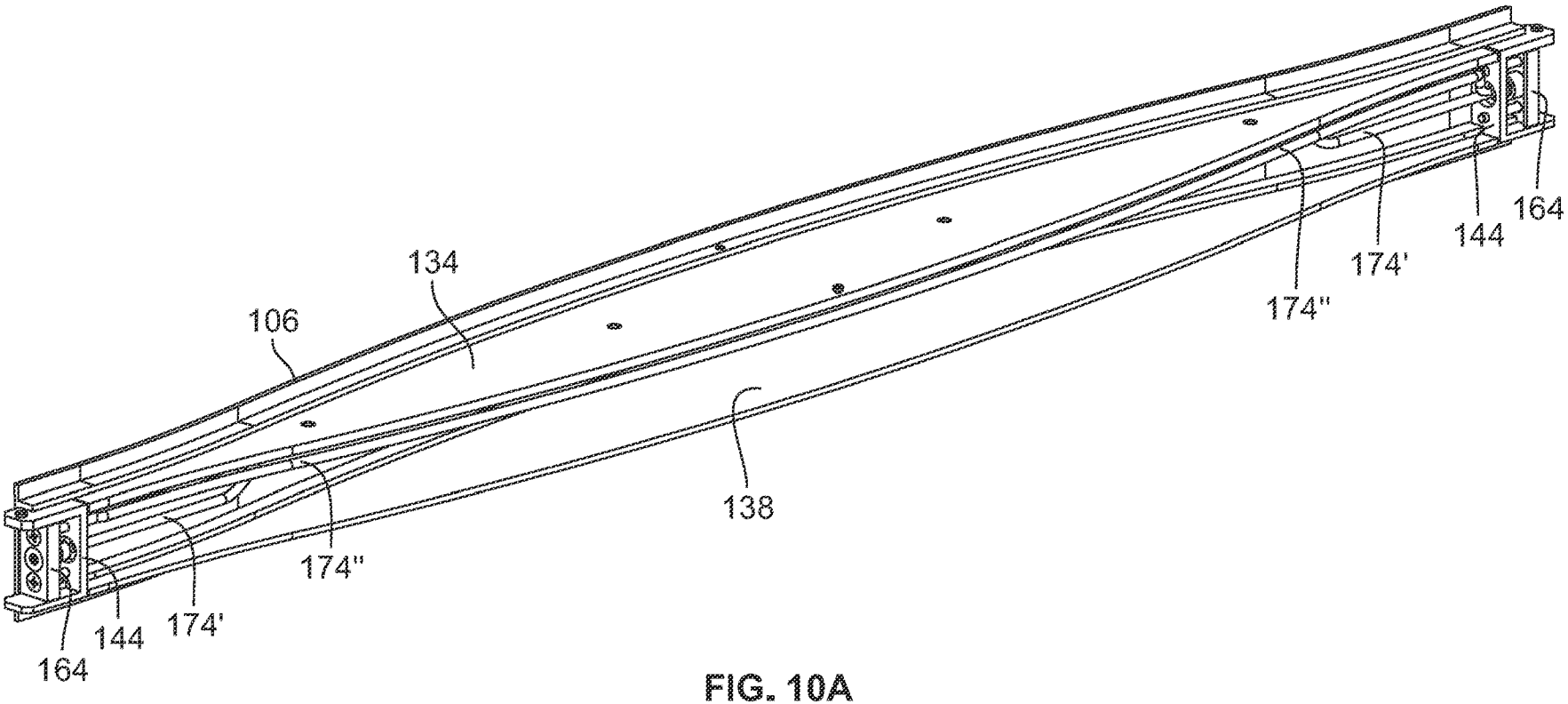
FIGS. 10A and 10B are perspective view of the luminaire of FIG. 1 with a sidewall removed therefrom.
Figure 10B:
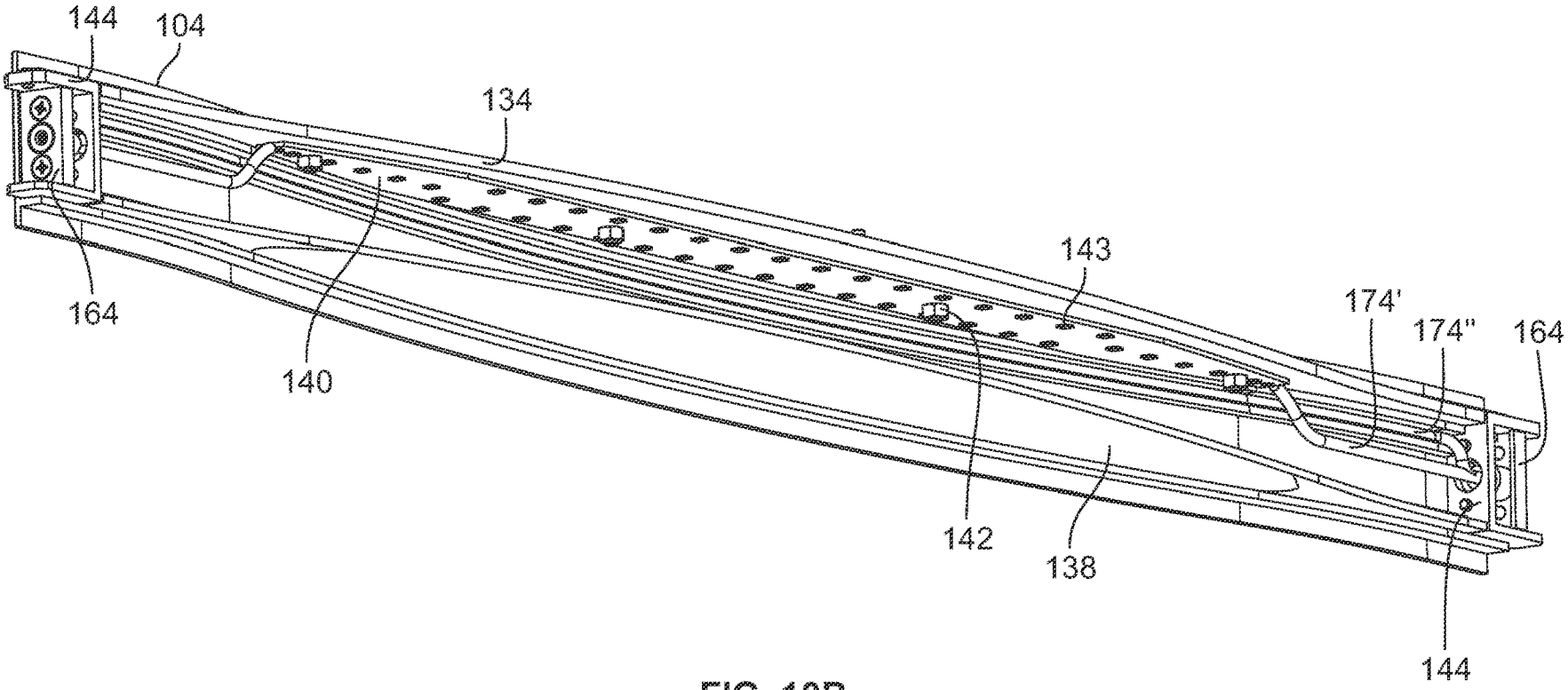
Figure 11:
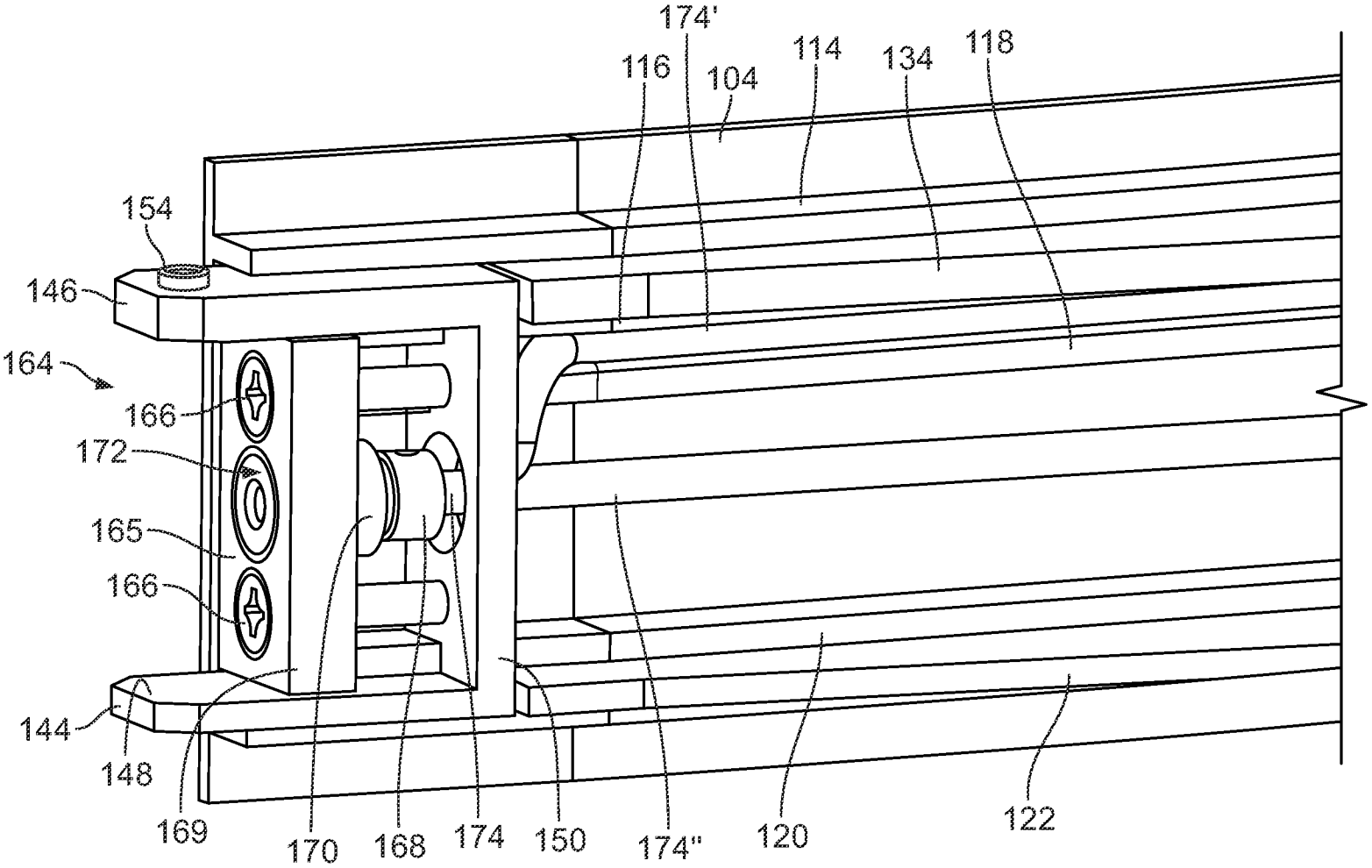
FIG. 11 is a perspective sectional view of the luminaire of FIG. 1 depicting elements thereof in an assembled state.
Figure 12:
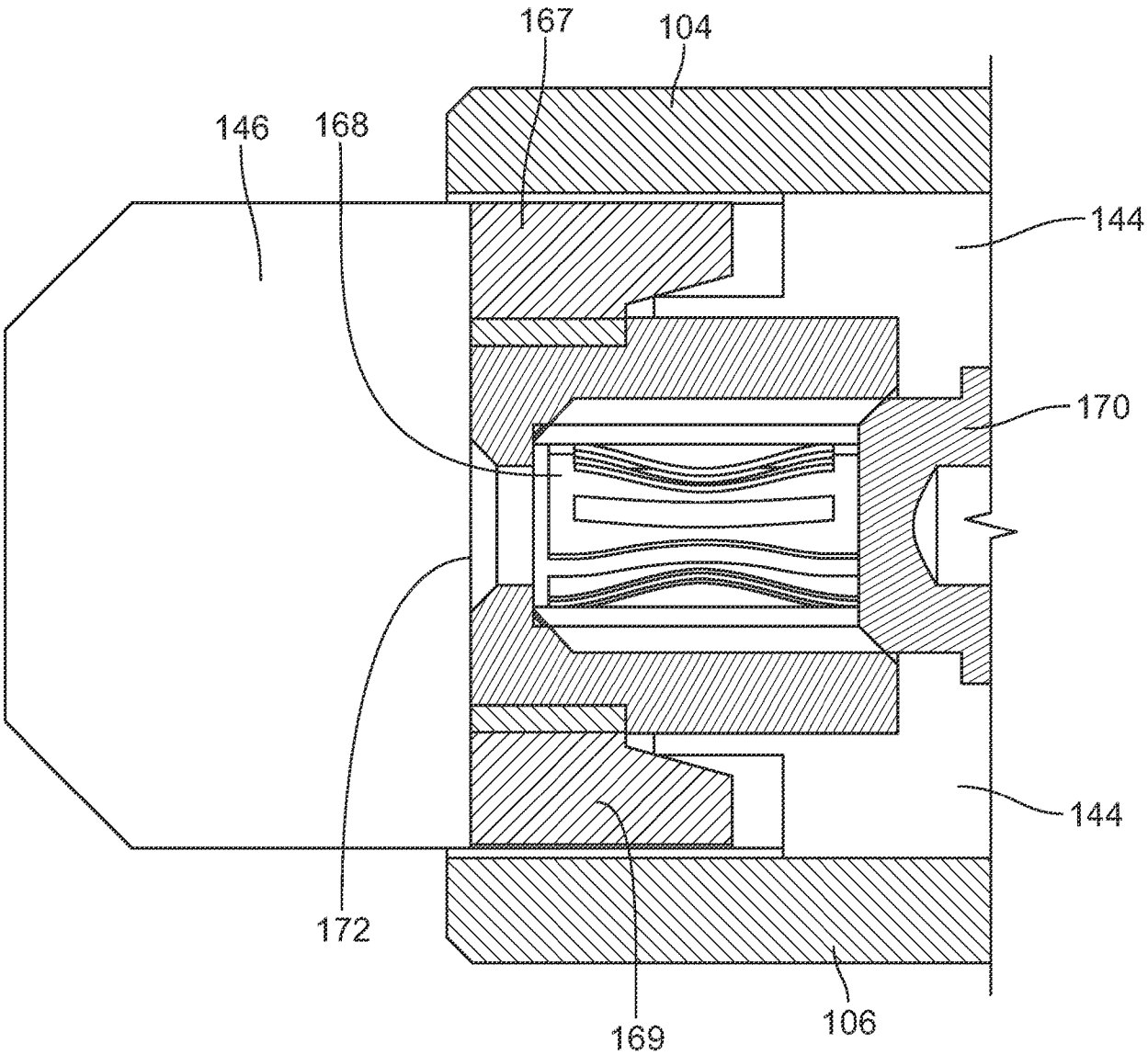
FIG. 12 is a detail partial cross-sectional view of an end of the luminaire of FIG. 1 depicting elements thereof in an assembled state.
Figure 13:
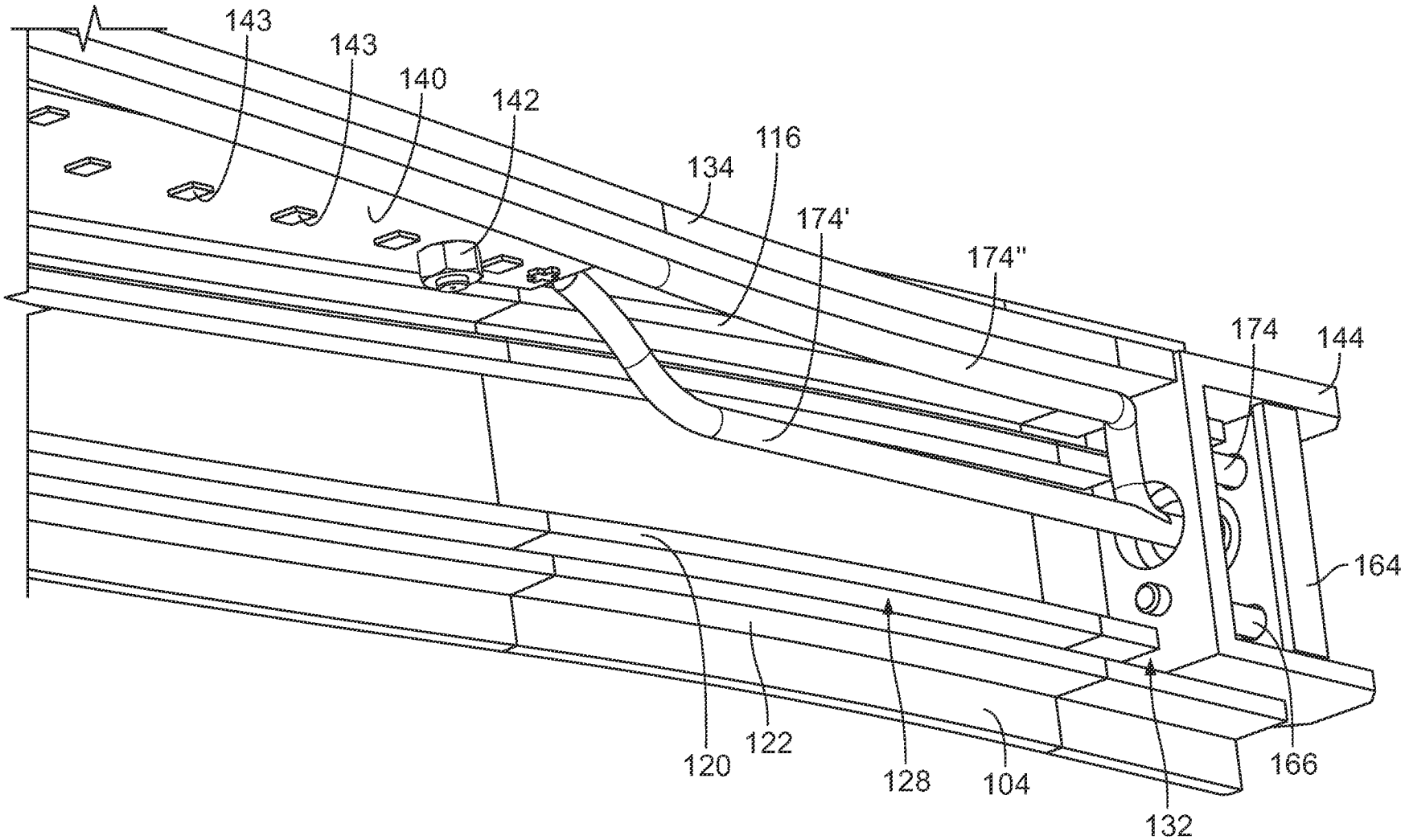
FIG. 13 is a perspective sectional view of the luminaire of FIG. 1 depicting elements of the luminaire of FIG. 1 in an assembled state.
Figure 14:
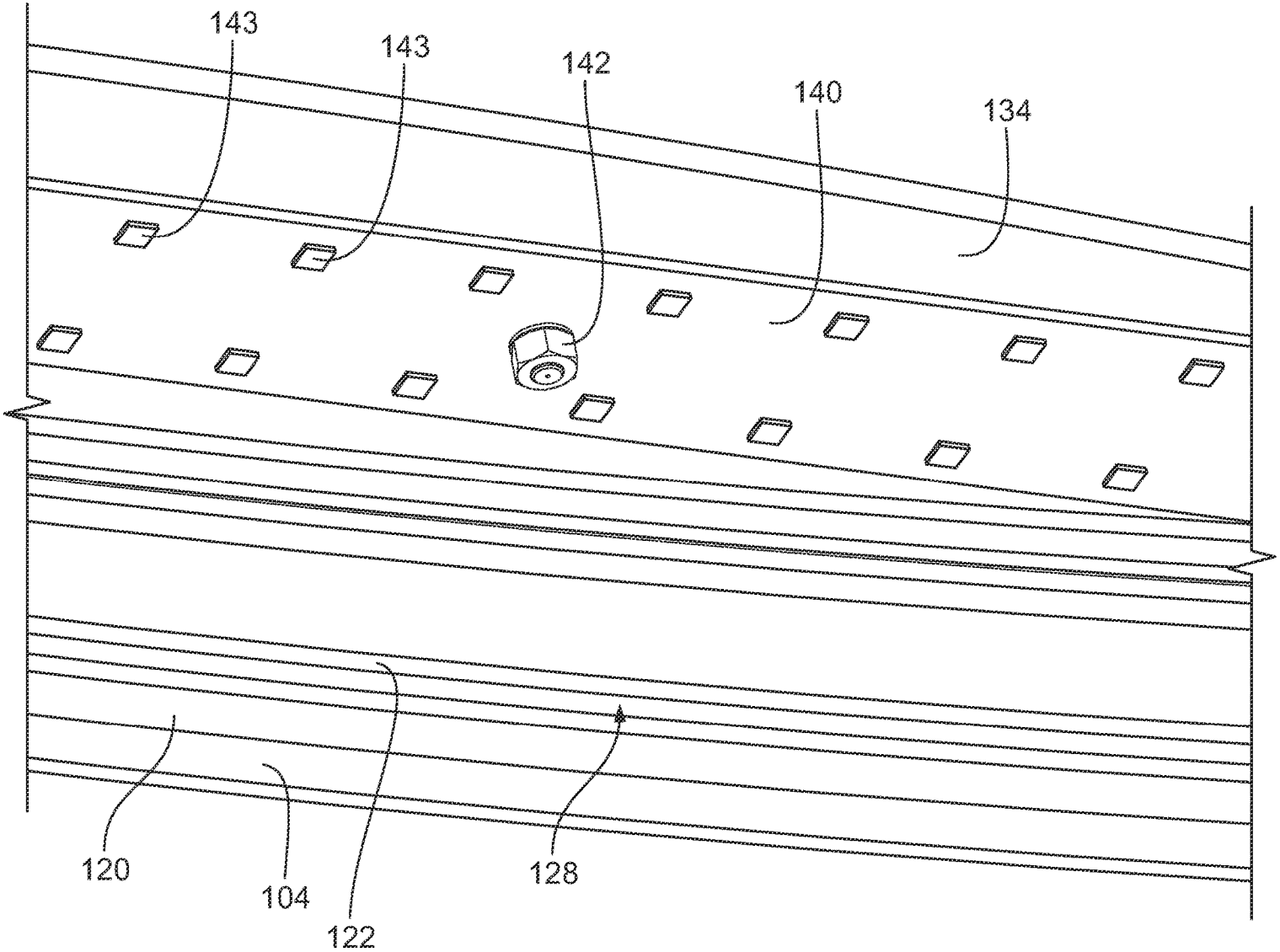
FIG. 14 is a detail view showing a fastener contacting a printed circuit board to transfer a negative current to the printed circuit board to aid in illuminating the light emitting diodes fixed to the printed circuit board.
Figure 15:
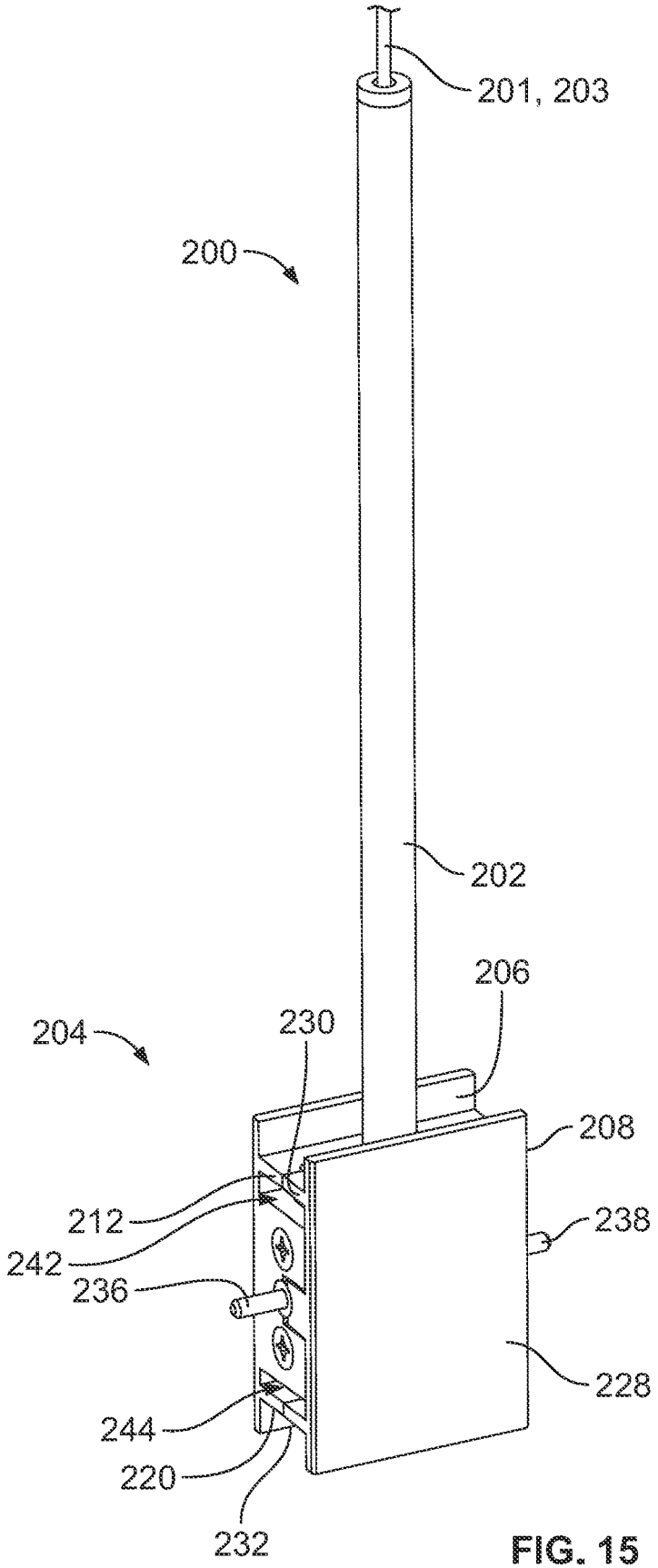
FIG. 15 is a perspective view of an inline connector that is configured to adjoin two of the luminaires of FIG. 1 according to an exemplary embodiment of the present disclosure.

As illustrated in FIG. 10B, a printed circuit board 140 can be fixed to the top plate 134 by a plurality of fasteners 142 (e.g., set screws and associated nuts). In addition to securing the printed circuit board 140 to the top plate 134, the fasteners 142 provide pad contact to allow for negative current to be distributed directly to the printed circuit board 140 from the top plate (negative electrical current passes over the luminaire 100) and in turn eliminates the need for soldering of the printed circuit board 140 to the top plate 134. A plurality of light sources 143, such as light-emitting diodes (LEDs), can be fixed to the printed circuit board 140 and configured to emit light in a downward direction toward the diffuser 138.

FIGS. 8-13 further depict a first bracket 144 that is arranged within the luminaire 100 and has a first leg 146, a second leg 148 and a base 150 that extends between the legs 146, 148 to define a U-shape. The base 150 can include an opening 152 and the legs 146, 148 can each be configured to be arranged within opening sin a connector and secured to the connector by a fastener 154 (e.g., threaded to receive a set screw) as will be described further below. In an assembled state, the first bracket 144 is arranged at each end of the luminaire 100 between the sidewalls 104, 106, in the first channels 108, 109 and the third channels 112, 113 and associated spaces 124, 125, 126, 127, 128, 129 of the sidewalls 104, 106. The first bracket 144 abuts a first end 156 and a second end 158 of the top plate 134, respectively, and a first end 160 and a second end 162 of the diffuser 138, respectively.

A second bracket 164, as shown in FIGS. 8-13 and which includes a body 165 that has a first ramped flange 167 and a second ramped flange 169, is configured to interact with the first bracket 144, be arranged in the grooves 130, 131, 132, 133 of the first and second sidewalls 104, 106, respectively, and arranged between the first leg 146 and the second leg 148 of the first bracket and fixed to the first bracket 144 by one or more fasteners (e.g., machine screws) 166. When the second bracket 164 is fastened to the first bracket 144, the second bracket 164 is pulled toward the first bracket 144 such that a ramp section of the second bracket 164 engages the grooves 130, 131, 132, 133 and forces the brackets 144, 164 into a tightly fit space at the ends of the luminaire 100.

A female port 168 that includes an insulated exterior 170 (e.g., insulated with plastic) is arranged in an opening 172 of the second bracket 164. A heavy gauge wire 174 is connected to the port 168 (e.g., soldered) and extends through the opening 152 in the first bracket 136 to transfer positive current to the printed circuit board 140 and illuminate the light source(s) 143. As can be seen in FIGS. 8, 10A-11 and 13, a portion of the wire 174 then splits into two wires, including a first wire 174' and a second wire 174", to divide the current with the first wire 174' connected (i.e., soldered) to the printed circuit board 140 and the second wire 174" bypassing the printed circuit board 140 and reconnecting with the first wire 174' at the other end of the luminaire 100. The wire 174 is separated into two wires 174', 174" so that only half of the positive current is directed to the printed circuit board 140 to illuminate the light sources 143 to prevent a voltage drop across the electrical system and resolve the inability of the printed circuit board 140 to handle full positive current of the electrical system.

FIGS. 15-24B illustrate various embodiments of connectors 200, 300, 400, 500 that are configured to join luminaire(s) 100 to each other as desired, transfer power from a power source to the luminaire(s) 100 and/or delimit a lighting system. The connectors 200, 300, 400, 500 include an inline connector 200 (FIG. 15) that is configured to connect two of the luminaires 100 to each other, an end connector 300 (FIG. 18) that is configured to be fixed to and delimit one end of the luminaire 100 (for the lighting system 100 two end connectors 200 are used), a corner or hex connector 400 (FIG. 20) that is curved to allow two of the luminaires 100 to be connected to each other at an angle and three-way or y-shaped connector 500 (FIG. 23) that is configured to connect three of the luminaires to each other.

To power the luminaire(s) 100, at least one of the connectors 200, 300, 400, 500 that is fixed to a luminaire 100 receives power from a power source and transfers that power to the luminaire 100 to illuminate the luminaire 100. It is noted that only a single connector 200, 300, 400, 500 in a lighting system is required to transfer power throughout a lighting system to the luminaire(s) 100 and the other connectors can be fixable to a surface (e.g., ceiling) by a cable 201, 301, 401, 501 (e.g., aircraft cable) to aid in suspending the lighting system from the surface. in some The power can be transferred, for example, by a coaxial cable 203, 303, 403, 503 that can be arranged within a rigid tube 202, 302, 402, 502 that extends from each connector 200, 300, 400, 500 of a lighting system with the inner portion of the cable 201, 391, 401, 501 carrying positive electrical current and the outer portion of the cable carrying negative electrical current.

FIGS. 15-17B depict the inline connector 200 that is configured to be arranged between two of the luminaires 100. The inline connector 200 includes a body 204 that generally includes a first half body 206 and a second half body 208. The first half body 206 includes a sidewall 210, a top wall 212 that extends from the first sidewall 210 and includes a plurality of grooves 214, 216, 218, a bottom wall 220 that extends from the first sidewall 210, a first end wall 224 that is spaced from the top and bottom walls 212, 220 and extends from a first end of the first sidewall 210 and a second end wall 226 that is spaced from the top and bottom walls 212, 220 and that extends from a second end of the first sidewall 210. The second half body 208 includes a sidewall 228, a top wall 230 that includes a plurality of grooves (not shown) and that extends from the second sidewall 228, a bottom wall 232 that extends from the second sidewall 228, a first end wall 234 that is spaced from the top and bottom walls 230, 232 and that extends from a first end of the second sidewall 228 and a second end wall (not shown) that is spaced from the top and bottom walls 230, 232 and that extends from a second end of the second sidewall 228.

A first pin 236 is fixed within and projects from a first end of the inline connector 200 and a second pin 238 is fixed within and projects from a second end of the inline connector 200.

Figure 16A:
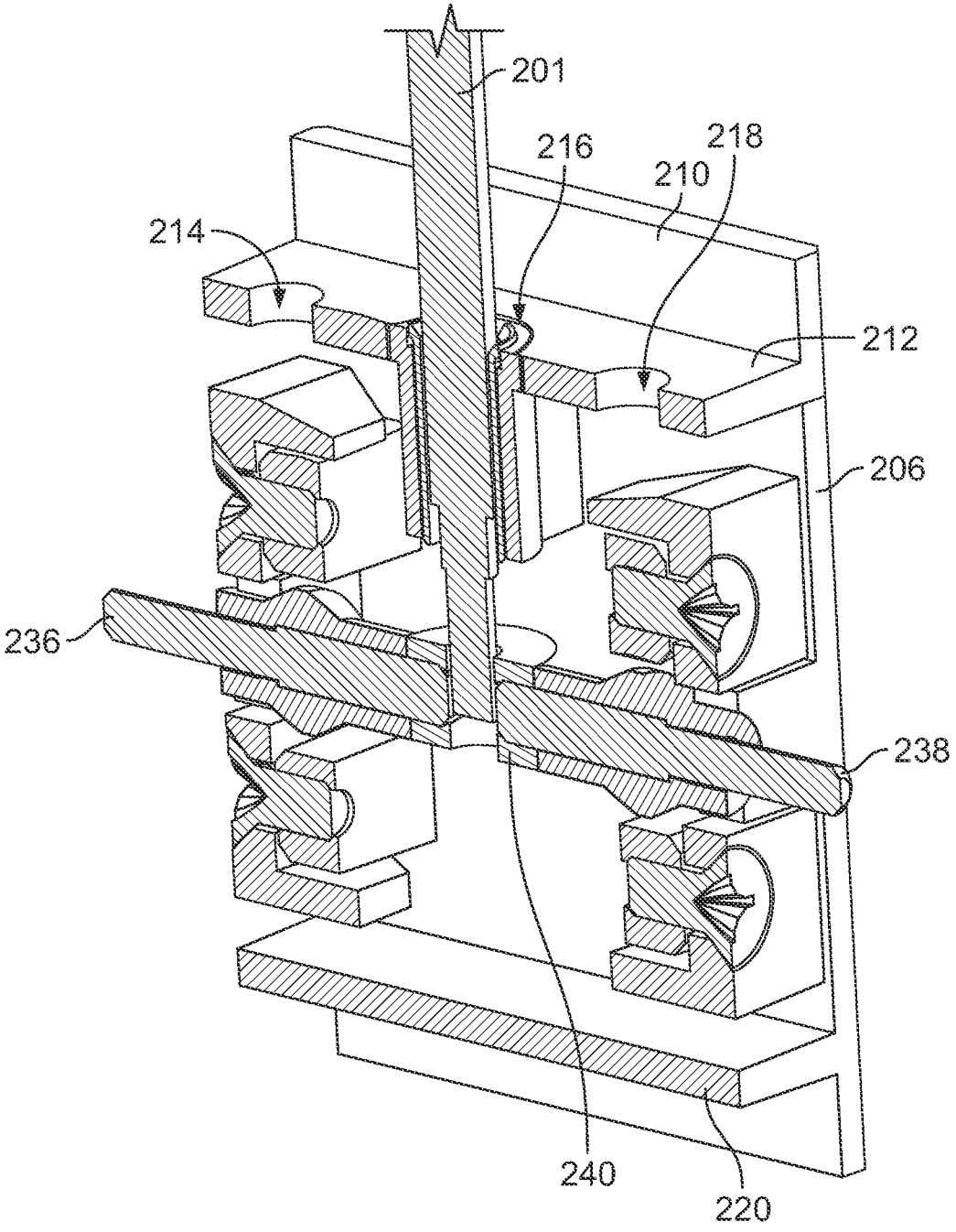
FIG. 16A is perspective cross-sectional view of the inline connector of FIG. 15 with power being distributed thereto.

When the cable 203 is arranged within the body 204 of the connector to transmit power to a luminaire 100, as shown in FIG. 16A, the inner wire/conductor of the cable 203 that has a positive current is fixed (i.e., soldered) to a plug 240. An end of the first pin 236 and an end of the second pint 238 that are arranged within the body 204 are also fixed (i.e., soldered) to the plug 240 to allow for a secure connection between the inner wire/conductor of the cable 203 that has a positive current and the pins 236, 238 to allow the pins 236, 238 to transfer positive current therefrom. The outer wire is arranged to directly contact the body 204 and transfer negative current over the body 204. To ensure the currents do not interfere with each other, the pins 236, 238, which receive positive current are insulated within the body 204 (e.g., with plastic).

Figure 16B:
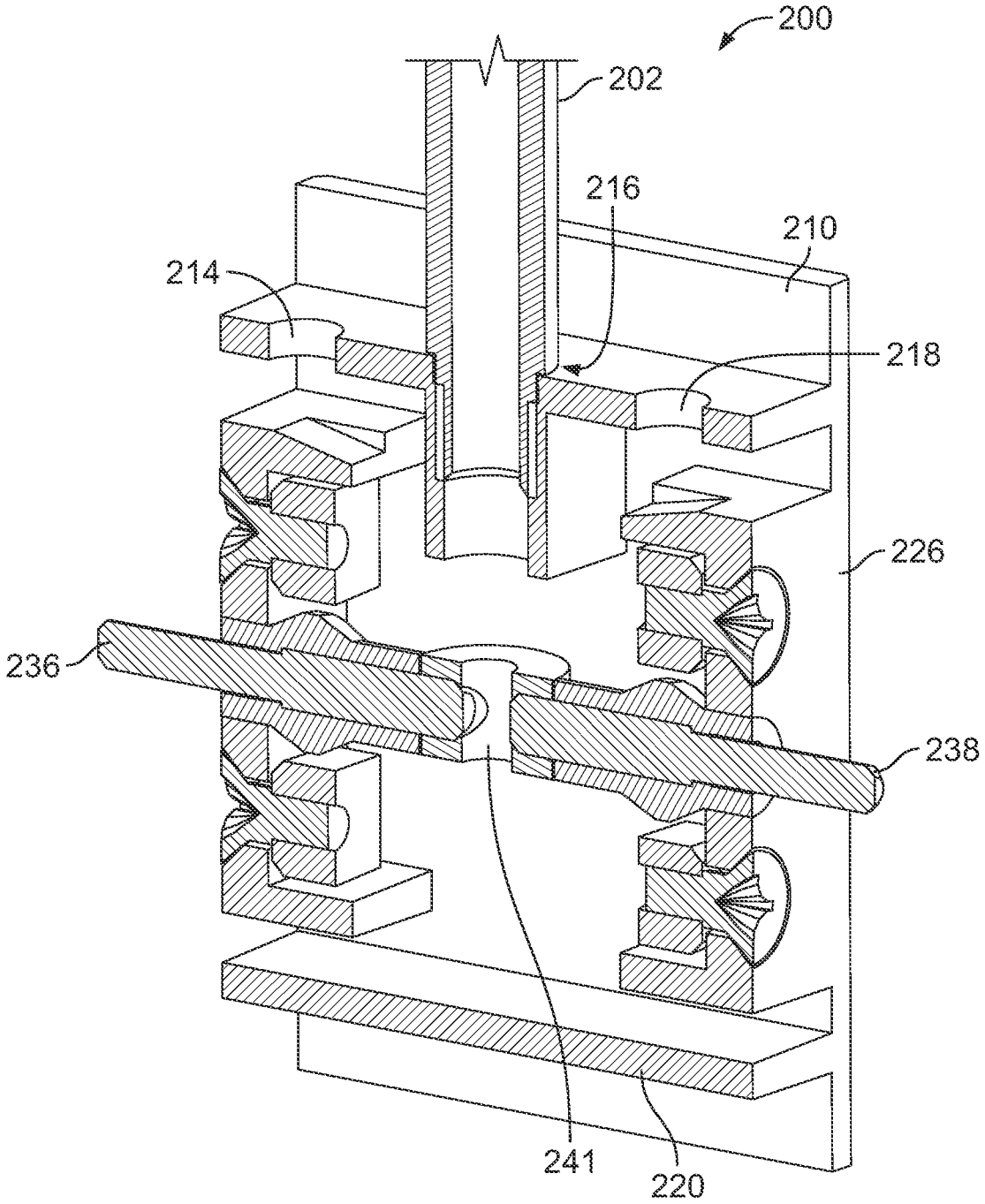
FIG. 16B is perspective cross-sectional view of the inline connector of FIG. 15 without power being distributed thereto.

FIG. 16B depicts the connector 200 to which power is not transmitted, but through which power can pass. Here, the cable is not arranged within the body 204. The connector 200 acts as a conduit to allow negative current travels over and about the connector 200 and positive current travels from one of the pins 236, 238 over a plug 241 to the other of the pins 236, 238.

Figure 17A:
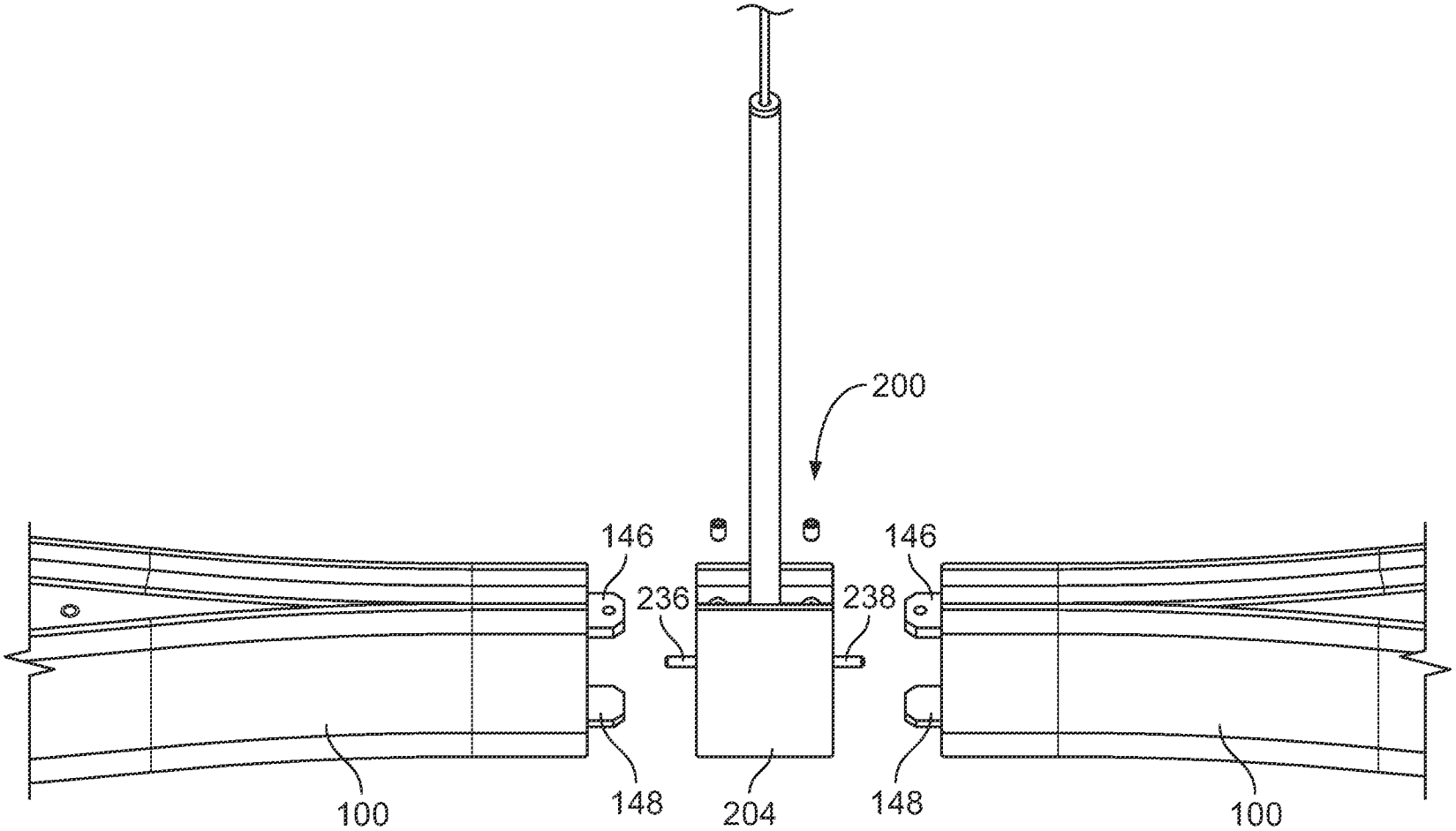
FIGS. 17A and 17B are assembly views of the inline connector of FIG. 15.
Figure 17B:
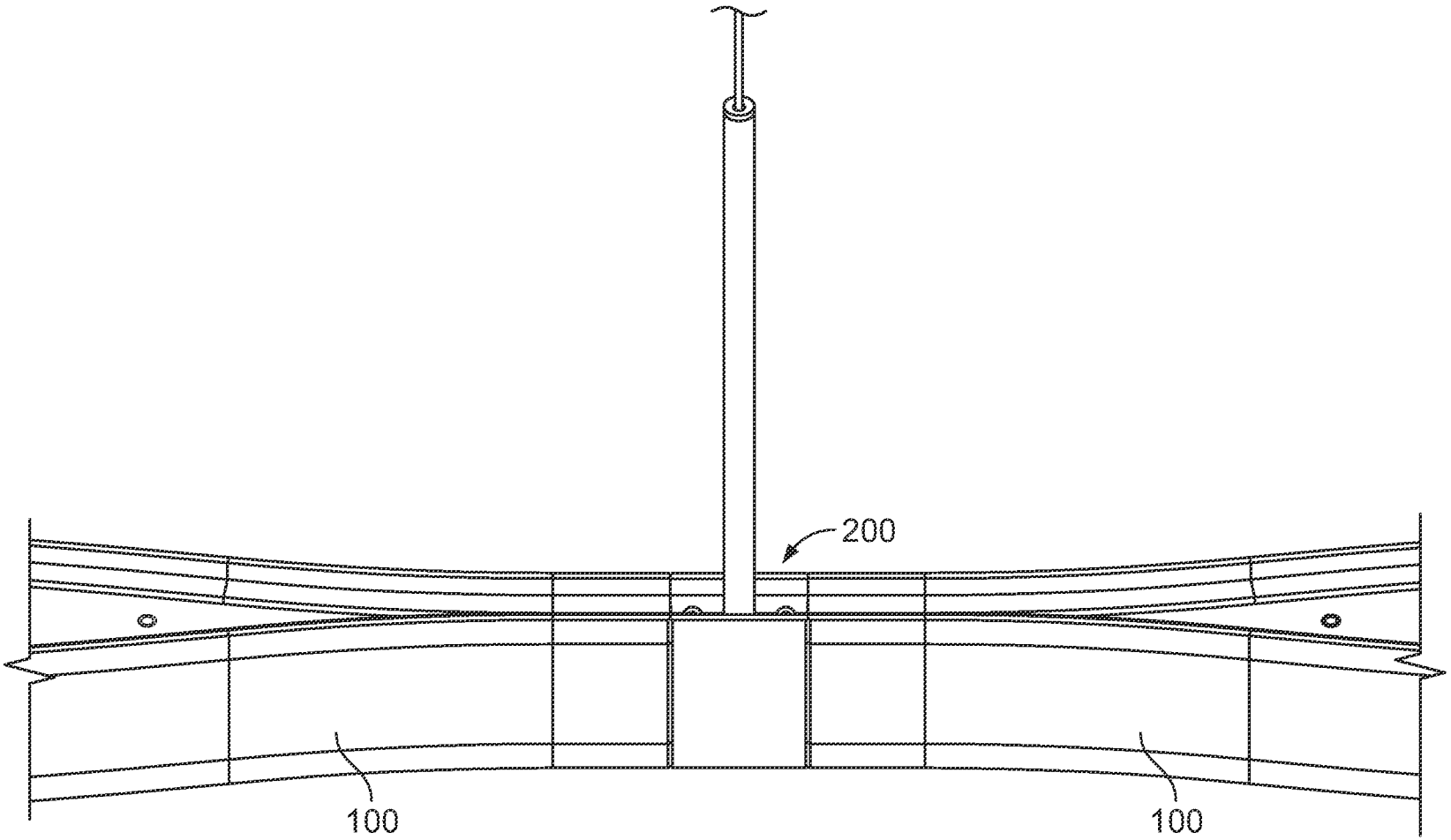

In an assembled state as shown in FIGS. 17A and 17B, the pins 236, 238 are arranged within the opening 172 in the second bracket 164 of a first luminaire 100 and a second luminaire 100, respectively, and the legs 146, 148 of the first bracket 144 are arranged within slots 242, 244 formed within the ends of the body 204 of the connector 200 and fastened (e.g., by fasteners 154) to the connector 202.

Because at least one connector of a lighting system delivers power to the system, positive current is transferred from the pins 236, 238 to the luminaire 100 through the connector 168 and over the heavy gauge wire 174 that is split such that half of the positive current is directed via the first wire 174' to the printed circuit board 140 and light source 143 fixed thereon and the other half of the positive current travels over the second wire 174" and bypasses the printed circuit board 140 and light source 143 because of inability of the printed circuit board 140 and light source 143 to handle full current of the electrical system. The second wire 174" rejoins another first wire 174' at the opposite end of the luminaire 100 transferred to the connector at the other end of the luminaire.

Negative current is transferred from the connector 200 to the printed circuit board 140 and the light source 143 when the connector 200 contacts the luminaire 100 by traveling about electrically conductive elements (sidewalls 104, 106, top plate 134, fasteners 142, etc.) of the luminaire 100.

It is noted that the internal elements of each of the other connectors 300, 400, 500 and configuration to transfer power of each is similar to the inline connector 200. The only difference is the orientation and number of pins that extend from the body of each connector 300, 400, 500. That is, negative current travels about electrically conductive elements of each of the connectors 300, 400, 500 and positive current travels via the pin or pins of the connectors 300, 400, 500.

When the connector 200, 300, 400, 500 is configured to not be a power source for the luminaire 100, all internal components thereof remain the same except a power cable is not arranged in the connector 200, 300, 400, 500 and a suspension cable or the like is included in place of the power cable to hang the light fixture.

Figure 18:
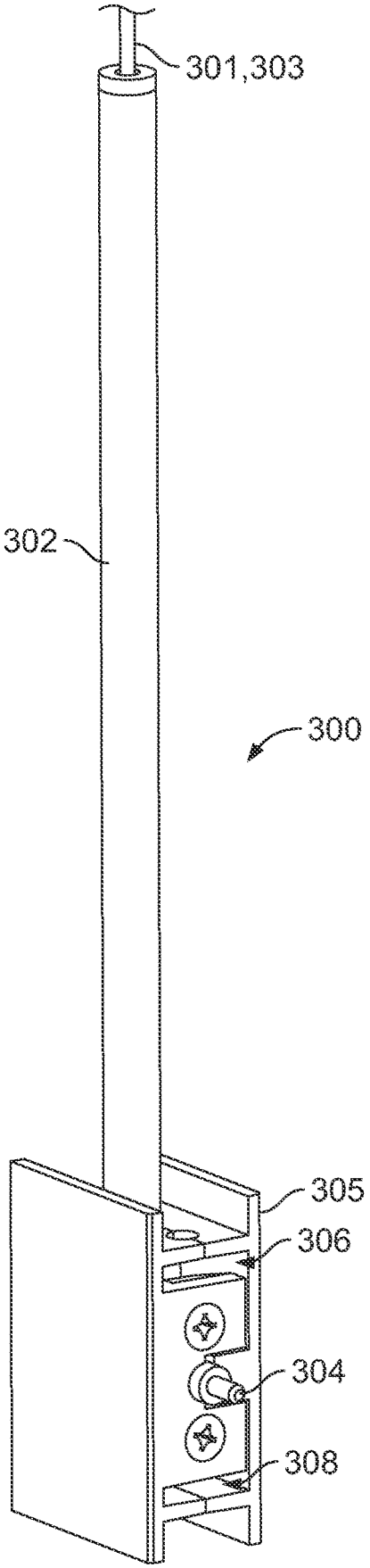
FIG. 18 is a perspective view of an end connector that is configured to attach to and delimit at least one end of the luminaire of FIG. 1 according to an exemplary embodiment of the present disclosure.
Figure 19A:
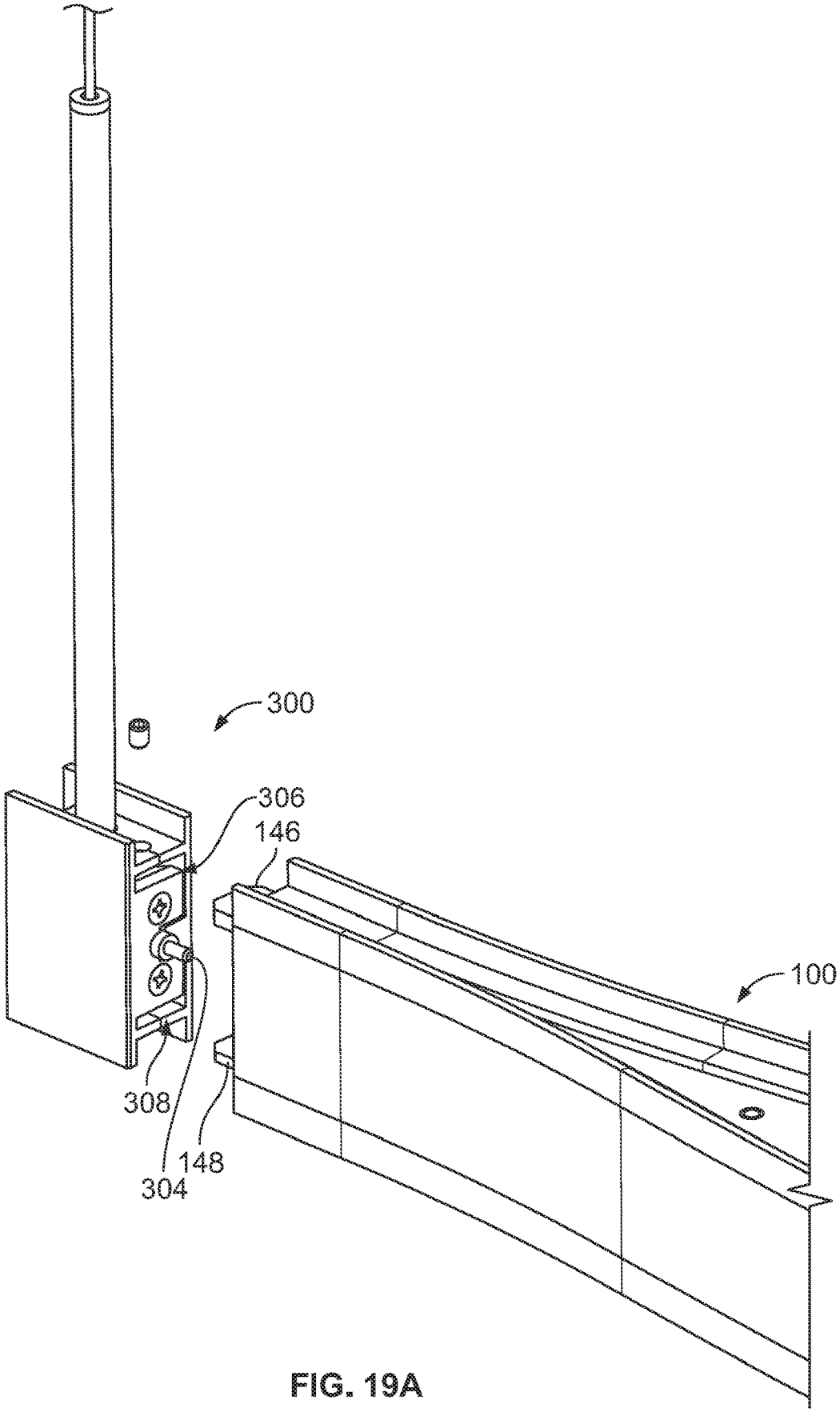
FIGS. 19A and 19B are assembly views of the end connector of FIG. 18.
Figure 19B:
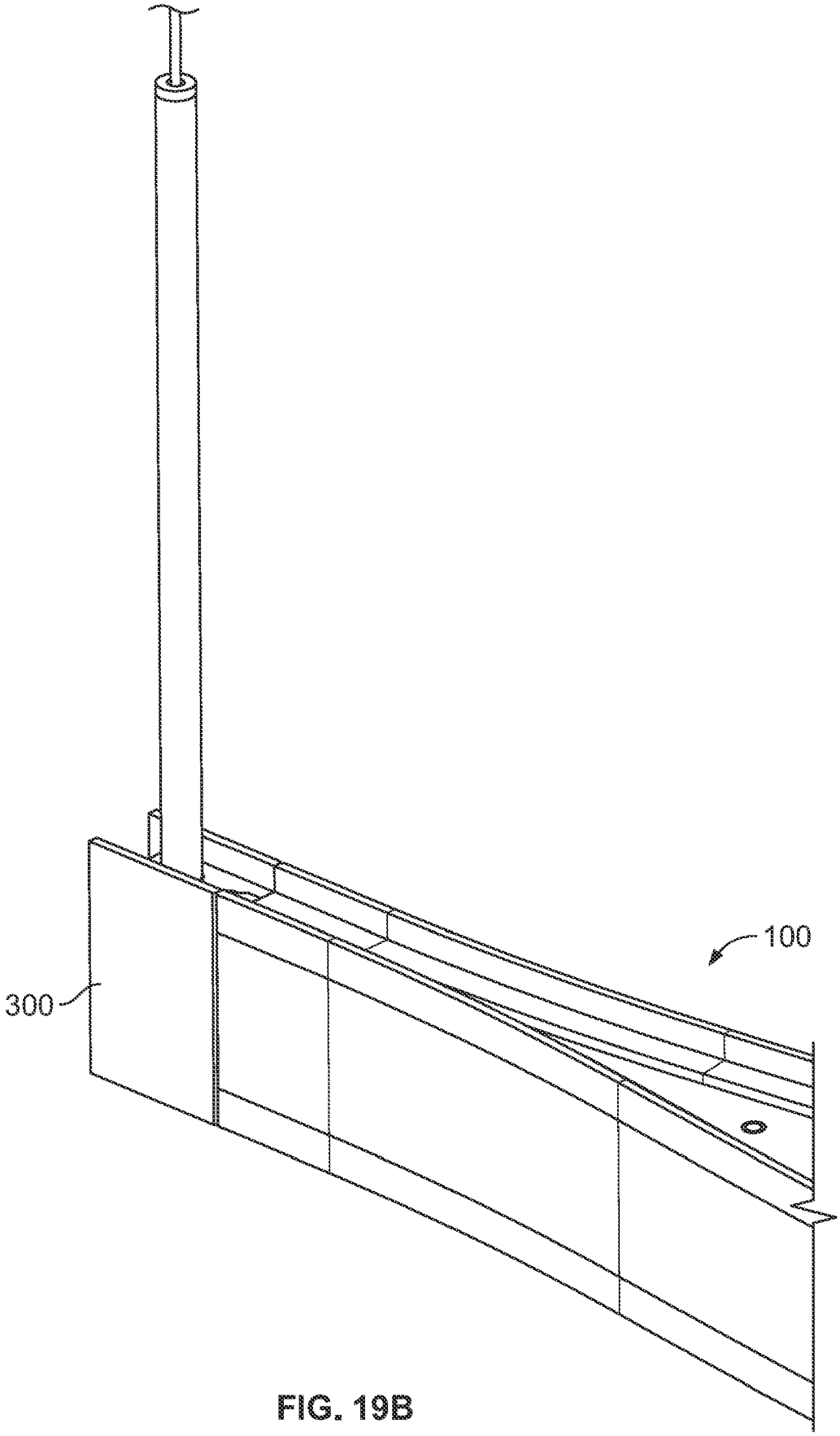

FIGS. 18-19B illustrate various views of the end connector or end cap 300 that is configured to be fixed to an end of the luminaire 100 and delimit a lighting system. The end cap 300 includes a housing 305 from which a pin 304 projects to transfer positive electrical current. The pin 304 as shown in FIGS. 19A and 19B is configured to be arranged within the female opening 172 in the second bracket 164 of the luminaire 100 and the legs 146, 148 of the first bracket 144 are arranged within slots 306, 308 of the body 204 of the connector 200 and fastened (e.g., by fasteners 154) to the connector 300. Similar to the other connectors 200, 400, 500, the end connector 300 transfers power irrespective of whether it is acting as a power source throughout the lighting system with negative current traveling over electrically conductive elements of the connector 300 and positive current traveling through the pin 304.

Figure 20:
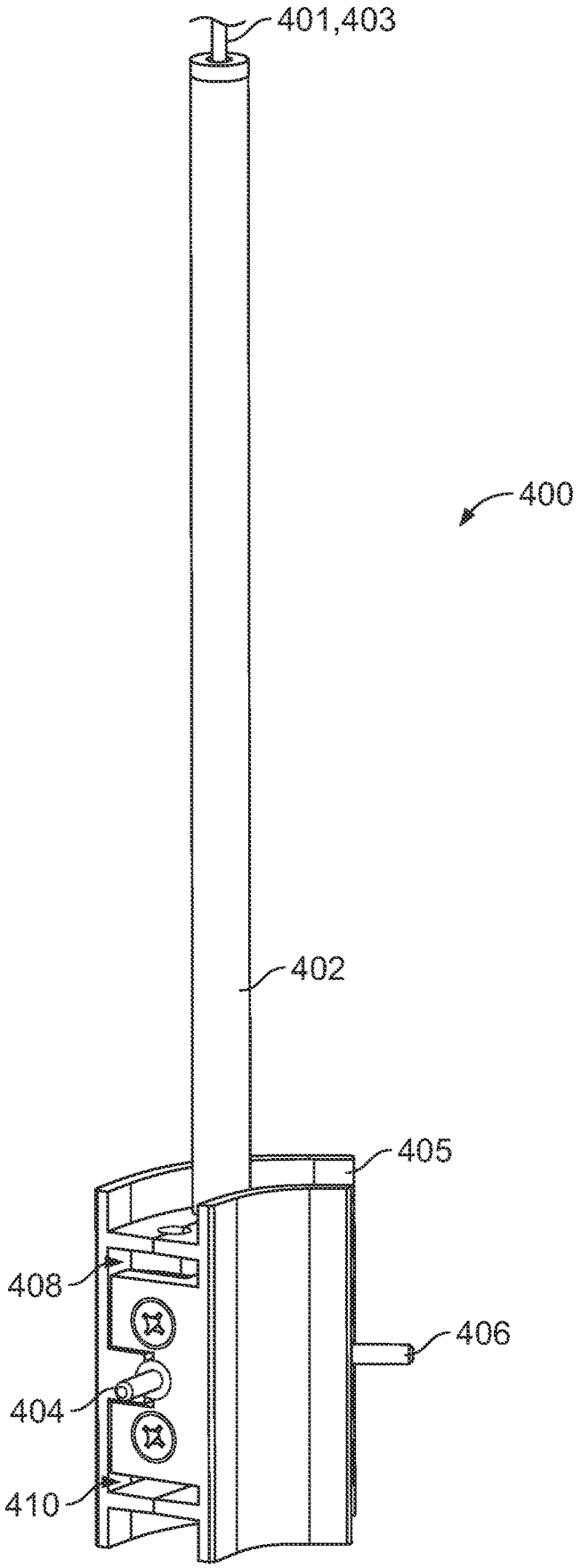
FIG. 20 is a perspective view of a corner or hex connector that is configured to adjoin two of the luminaires of FIG. 1 according to an exemplary embodiment of the present disclosure.
Figure 21A:
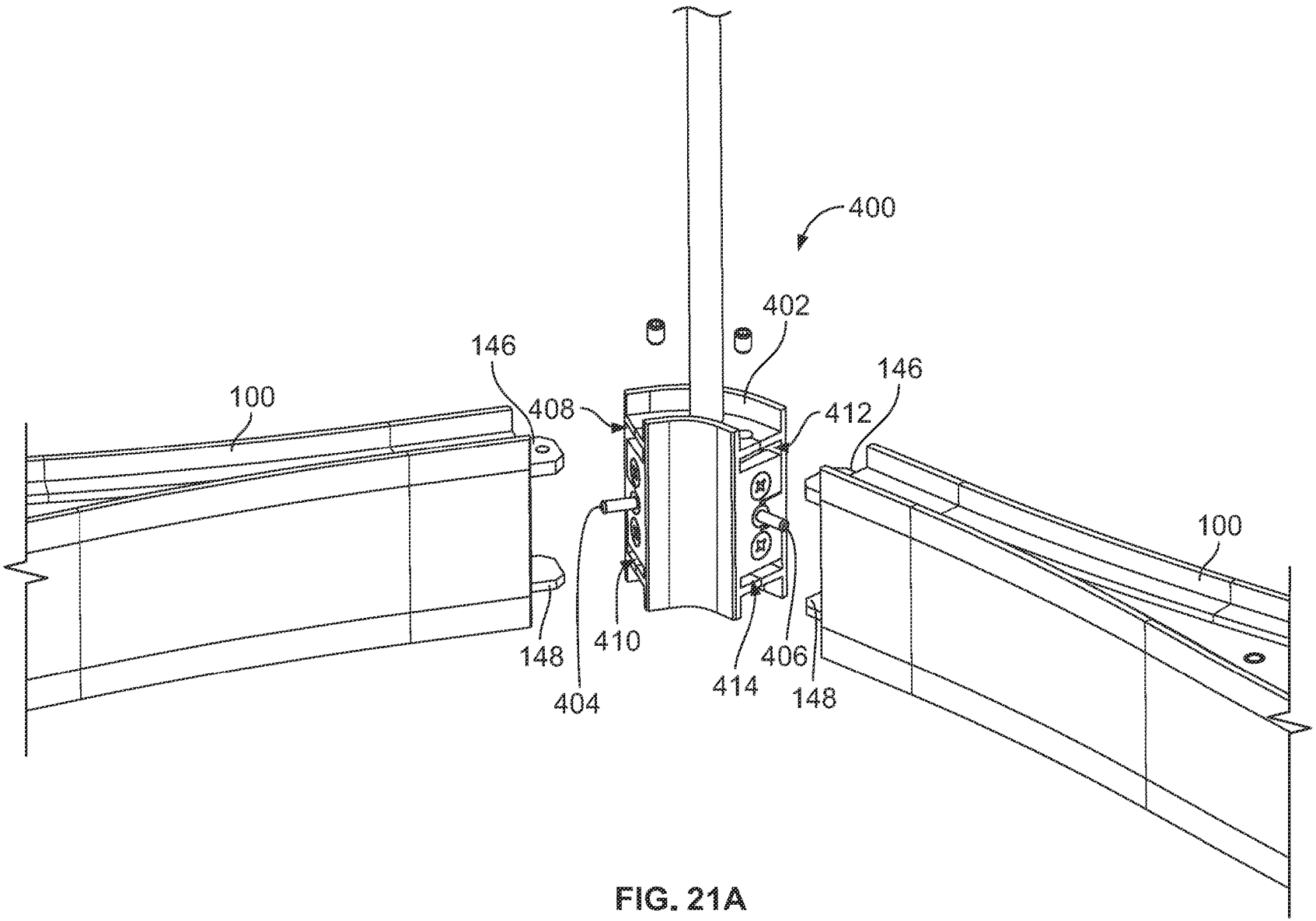
FIGS. 21A and 21B are assembly views of the corner or hex connector of FIG. 20.
Figure 21B:
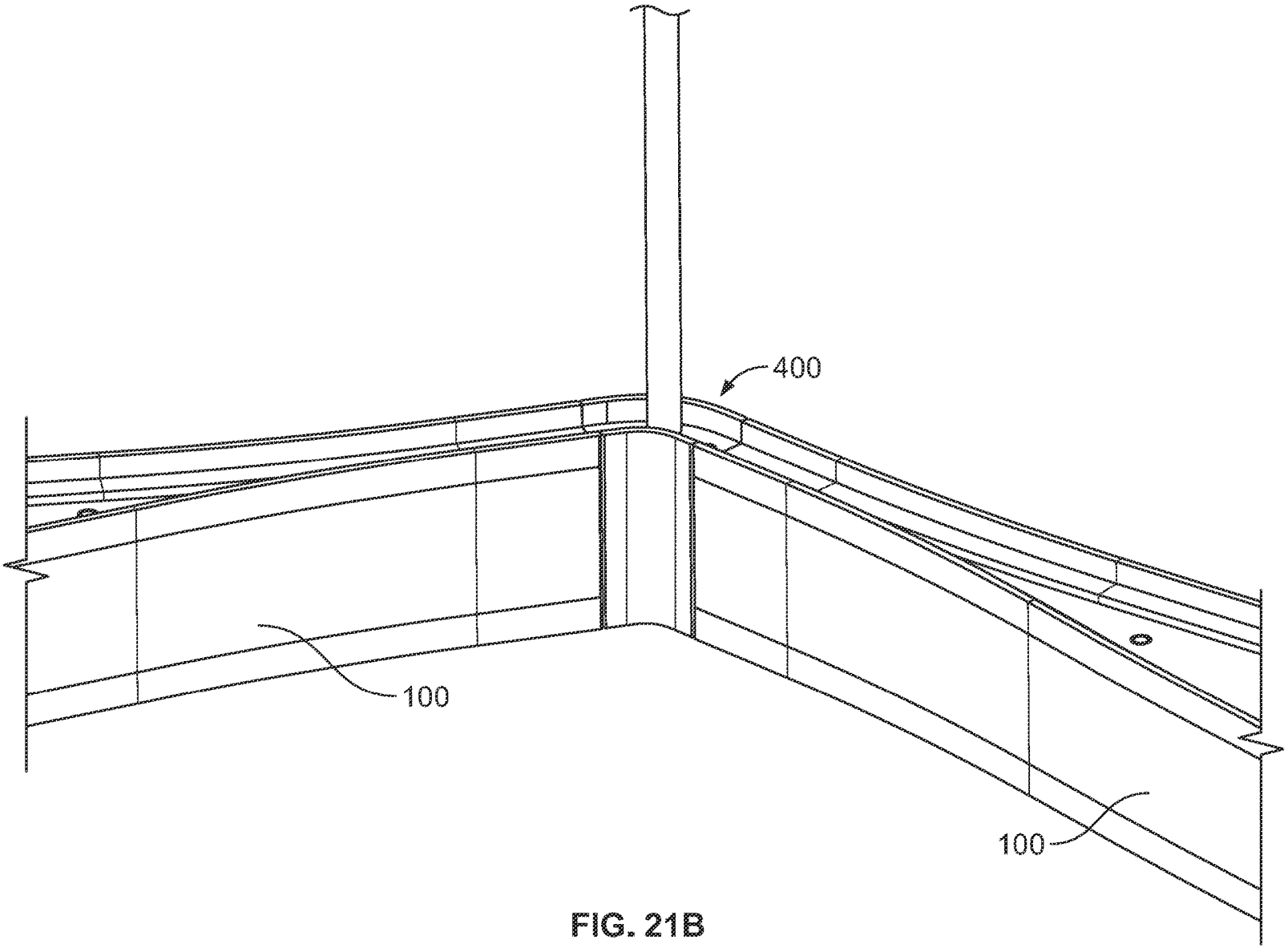
Figure 22:
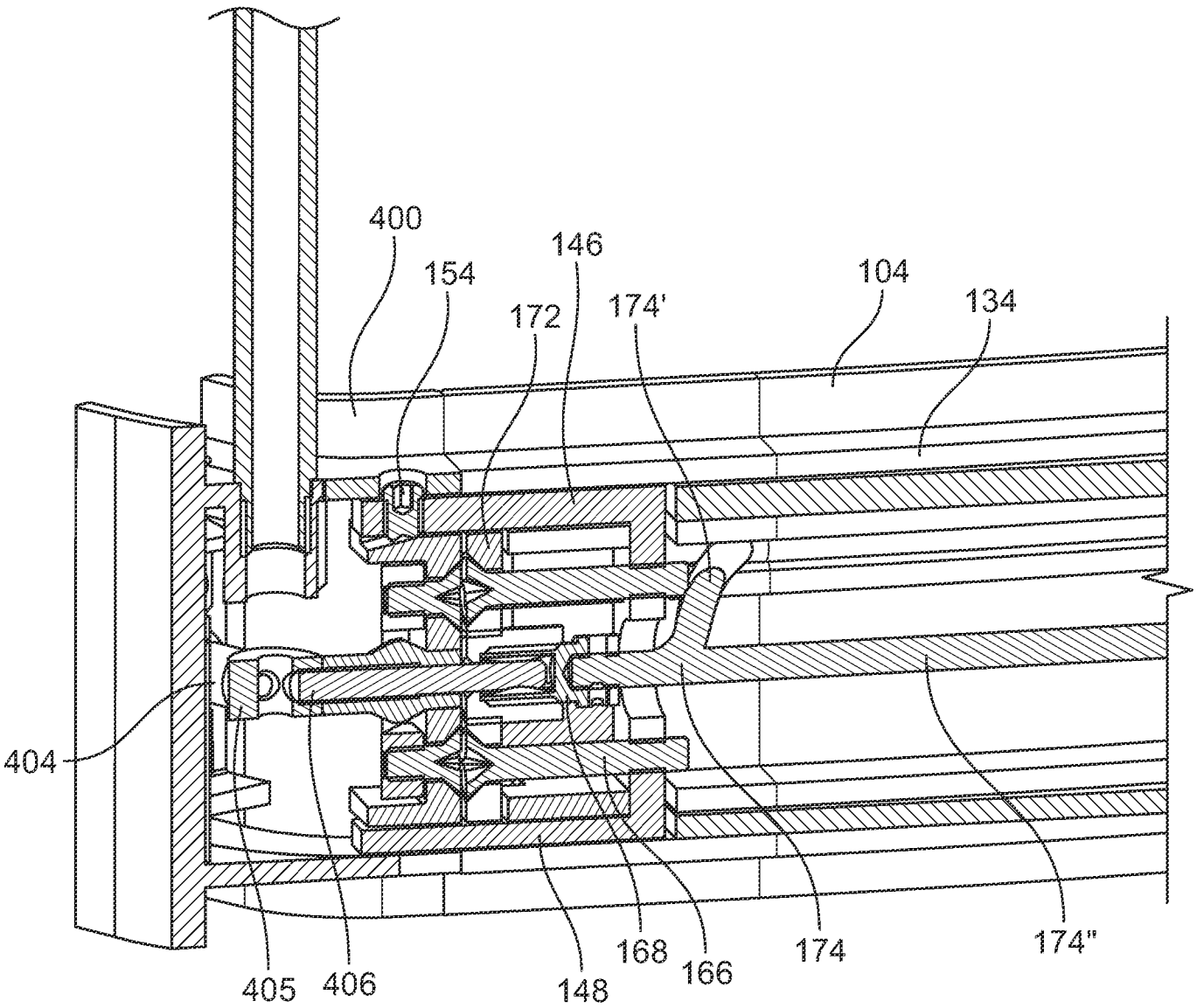
FIG. 22 is a cross-sectional view of the corner or hex connector of FIG. 20 in an assembled state with the luminaire of FIG. 1.

FIGS. 20-22 illustrate various views of the corner or hex connector 400 that is configured to be fixed to an end of a two of the luminaires 100 to connect the luminaires 100 at an angle. The corner connector 400 includes a housing 403 from which pins 404, 406 project to transfer positive electrical current. The pins 404, 406, as shown in FIGS. 21A-22 are configured to be arranged within the female opening 172 in the second bracket 164 of two of the luminaires 100 and the legs 146, 148 of the first bracket 144 of each luminaire are arranged within slots 408, 401, 412, 414 of the body 404 of the connector 400 and fastened (e.g., by fasteners 154) to the connector 400. Similar to the other connectors 200, 300, 500, the end connector 400 transfers power irrespective of whether it is acting as a power source throughout a lighting system with negative current traveling over electrically conductive elements of the connector 400 and positive current traveling through the pins 404, 406. FIG. 22 depicts a corner connector 400 that does not act as a power source for a lighting system (the power cable is not arranged in the connector 400). Here, negative current travels over the connector 400 and positive current travels from one of the pins 404, 406 over a plug 405 to the other of the pins 404, 406.

Figure 23:
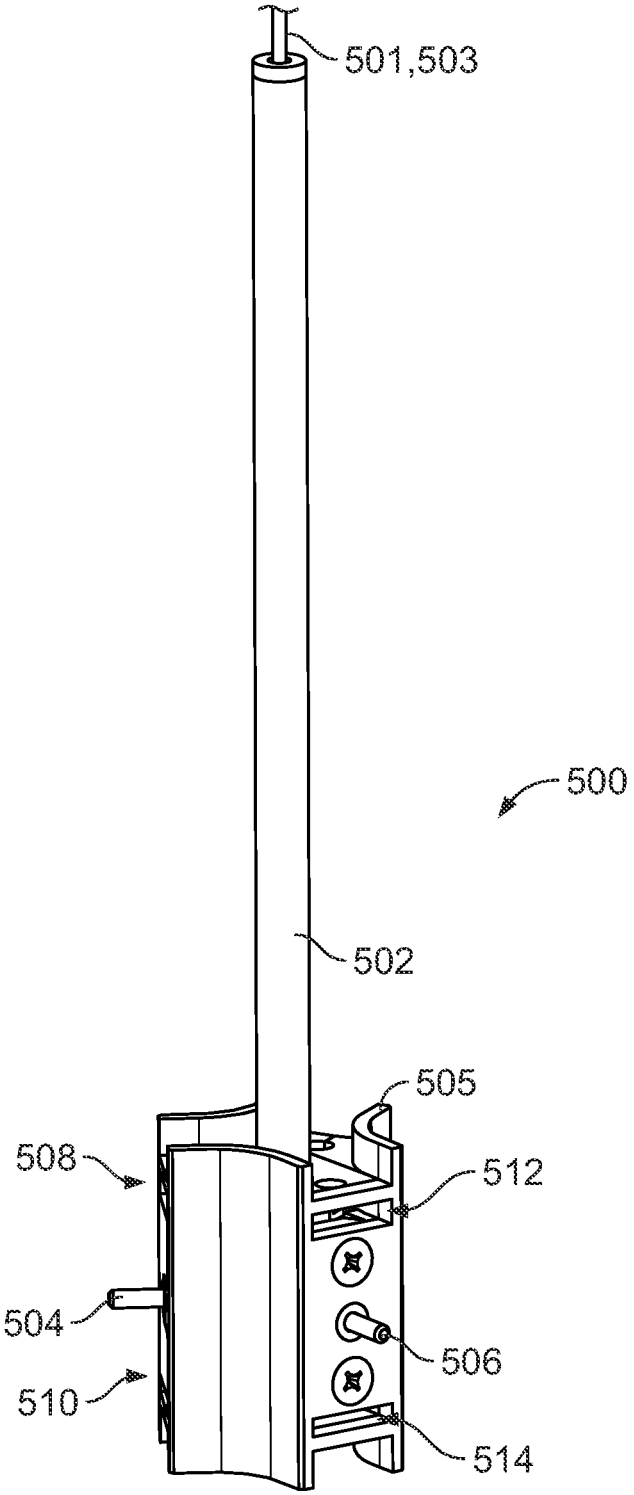
FIG. 23 is a perspective view of a three-way or y-shaped connector that is configured to adjoin three of the luminaires of FIG. 1 according to an exemplary embodiment of the present disclosure.
Figure 24A:
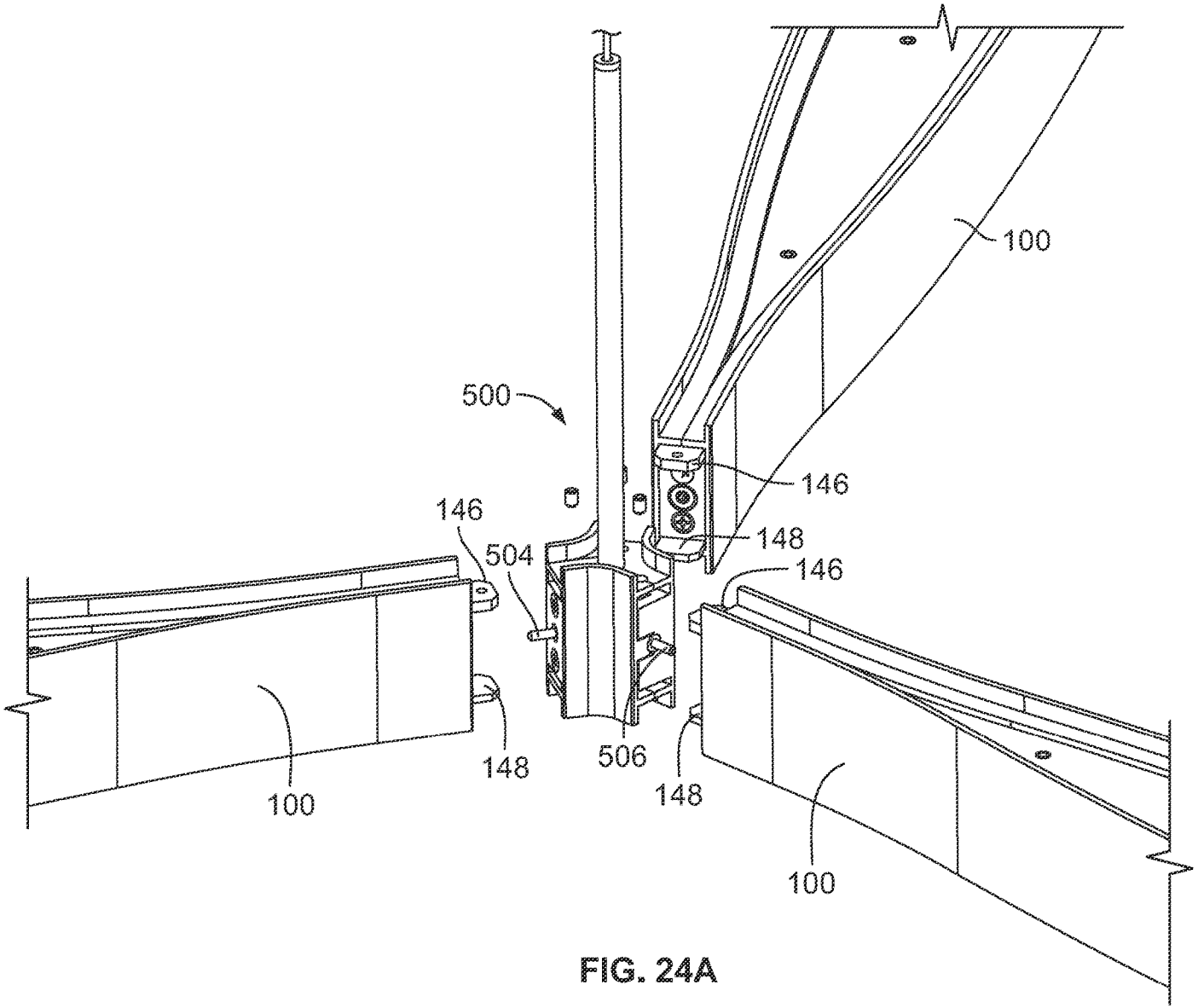
FIGS. 24A and 24B are assembly views of the three-way or y-shaped connector of FIG. 23.
Figure 24B:
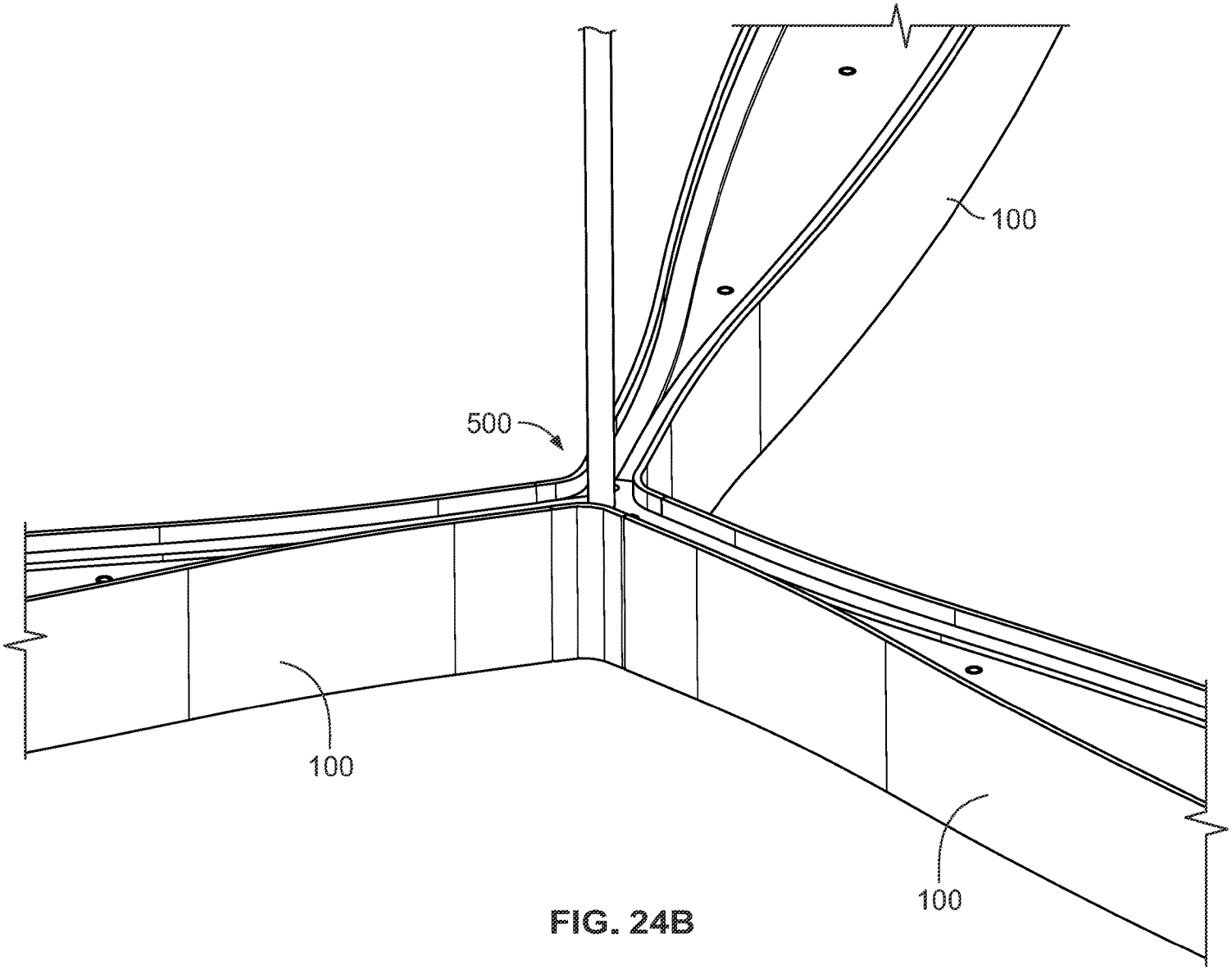

FIGS. 23-24B illustrate various views of the three-way or y-shaped connector 500 that is configured to be fixed to an end of a three of the luminaires 100 to connect the luminaires 100 at an angle to each other. The three-way connector 500 includes a housing 505 from which three pins, including a first pin 504, a second pin 506 and a third pin (not shown) project to transfer positive electrical current. The pins 504, 506, as shown in FIG. 24A are configured to be arranged within the opening 172 in the second bracket 164 of three of the luminaires 100 and the legs 146, 148 of the first bracket 144 of each luminaire 100 are arranged within a first set of slots 508, 510, a second set of slots 512, 514 and a third set of slots (not shown) of the body 504 of the connector 500 and fastened (e.g., by fasteners 154) to the connector 500. Similar to the other connectors 200, 300, 400, the connector 500 transfers power irrespective of whether it is acting as a power source throughout a lighting system with negative current traveling over electrically conductive elements of the connector 500 and positive current traveling through the pins 504, 506 and the pin not shown.

As noted above, the modular lighting system includes at least one of luminaire 100 that can be individually suspended from a surface or can be connected to another one or more luminaires 100 to form a variety of arrangements that project light downwardly therefrom. FIGS. 25-30 depict exemplary embodiments of lighting systems that combine one or more of the luminaires 100 with at least two of the connectors 200, 300, 400, 500 as described above. It is noted that the lighting system is configured to allow for an infinite number of scalable lighting systems of various configurations as desired.

Figure 25:
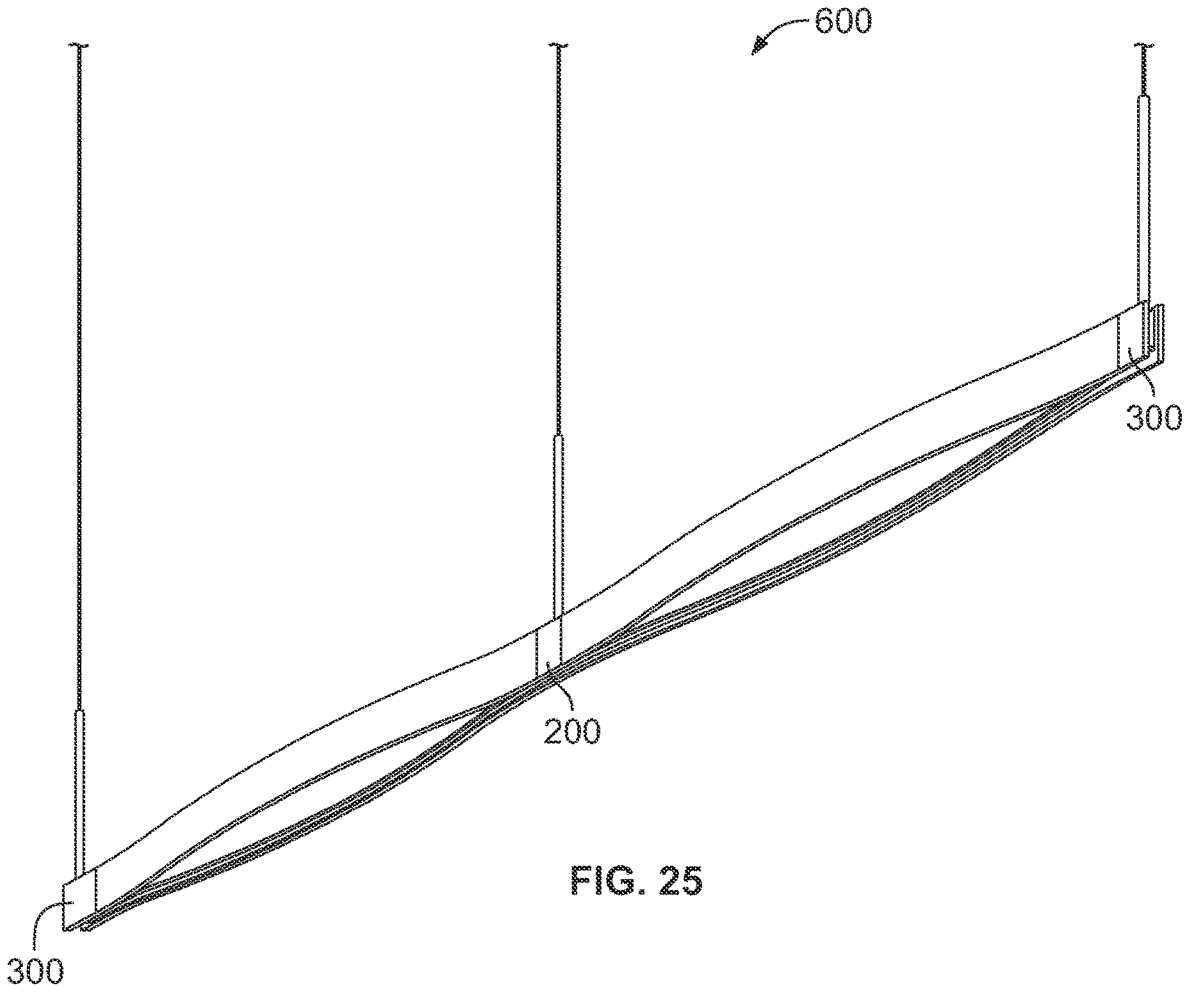
FIG. 25 is a perspective view of a modular lighting system that includes two of the luminaires of FIG. 1 connected to each other by the inline connector of FIG. 15 and delimited at a respective end of each luminaire by the end connector or end cap of FIG. 18 according to an exemplary embodiment of the present disclosure.

FIG. 25 is a perspective view of an exemplary embodiment of a modular lighting system that includes two of the luminaires 100 that are connected to each other by the inline connector 200 and delimited at a respective end of each luminaire 100 by the end connector or end cap 300.

Figure 26:
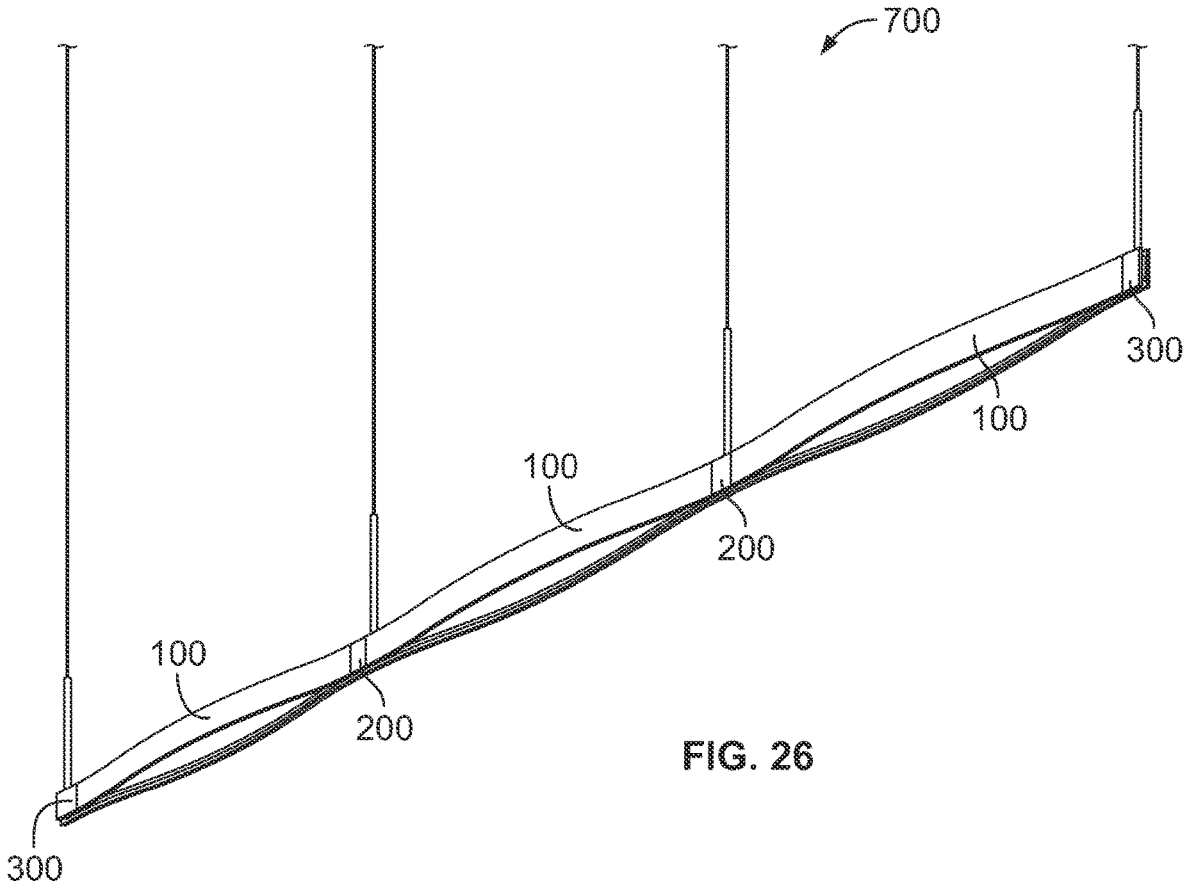
FIG. 26 is a perspective view of a modular lighting system that includes three of the luminaires of FIG. 1 that are connected to each other by two of the inline connectors of FIG. 15 and delimited at the ends of the lighting system by the end connector or end cap of FIG. 18 according to an exemplary embodiment of the present disclosure.

FIG. 26 is a perspective view of an exemplary embodiment of a modular lighting system that includes three of the luminaires 100 that are connected to each other by two of the inline connectors 200 and delimited at the ends of the lighting system by an end connector or end cap 300.

Figure 27:
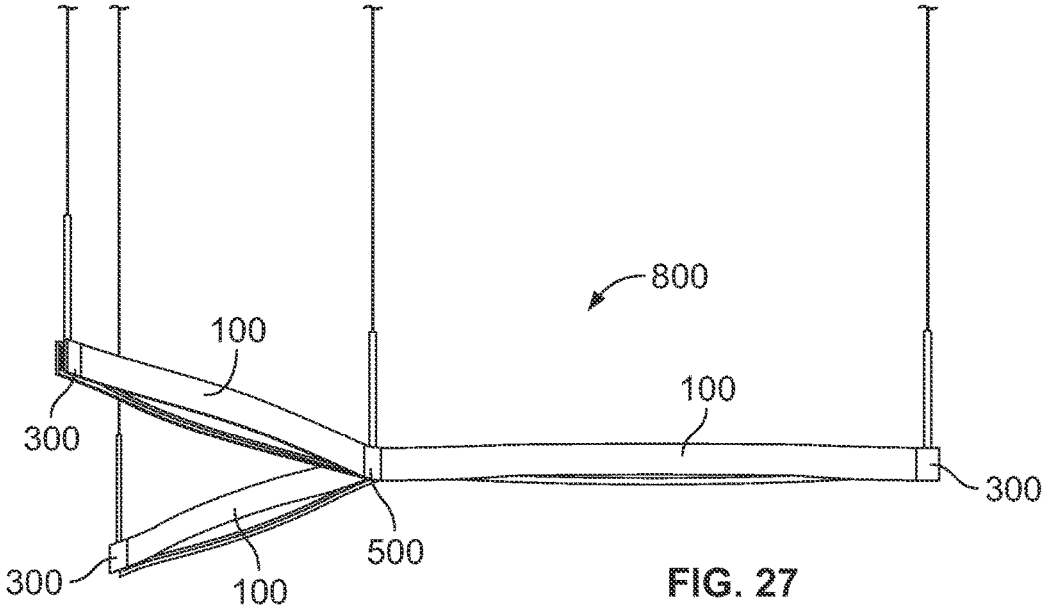
FIG. 27 is a perspective view of a modular lighting system that includes three of the luminaires of FIG. 1 that are connected to each other at one end by a three-way or y connector of FIG. 22 and delimited at the other end of each luminaire by the end connector or end cap of FIG. 18 according to an exemplary embodiment of the present disclosure.

FIG. 27 is a perspective view of an exemplary embodiment of a modular lighting system that includes three of the luminaires 100 that are connected to each other at one end by the three-way or y connector 500 and delimited at the other end of each luminaire by the end connector or end cap 300.

Figure 28:
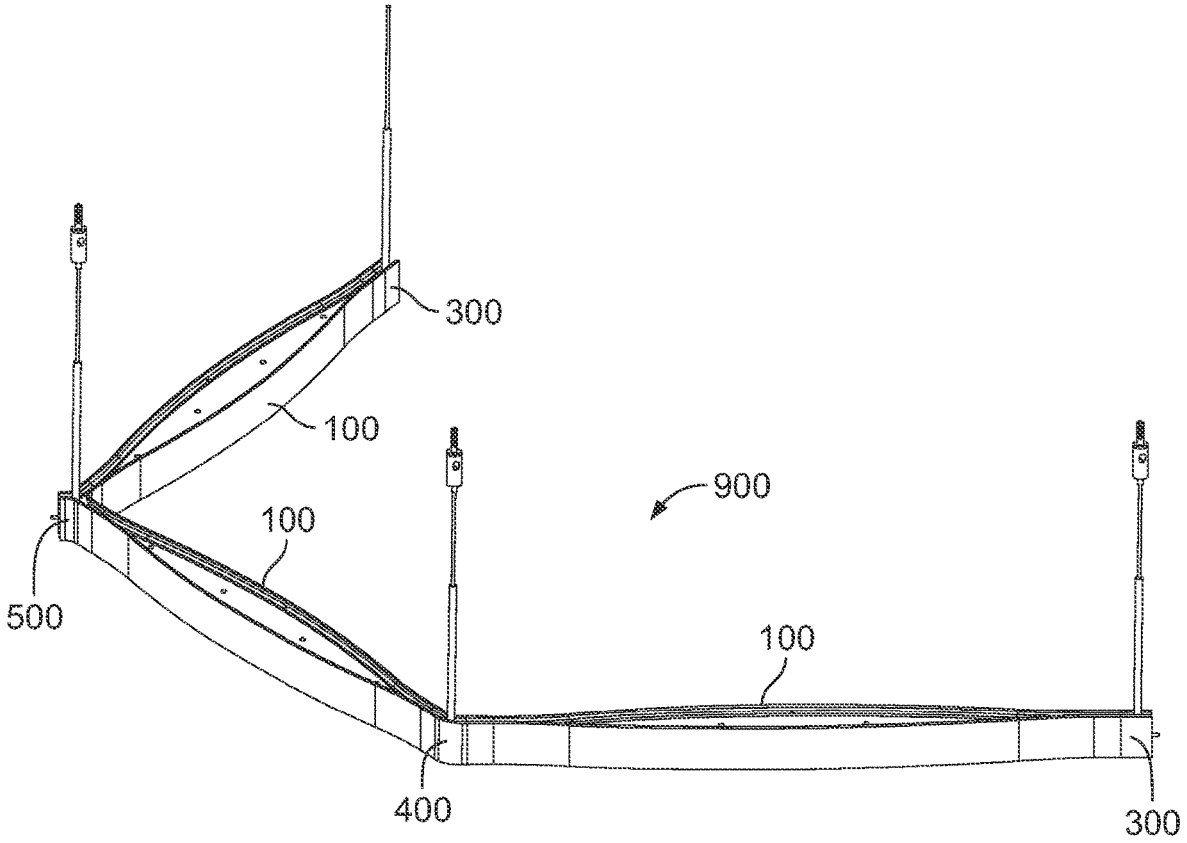
FIG. 28 is a perspective view of a portion of modular lighting system that includes three of the luminaires of FIG. 1 that are connected to each other by various connectors according to an exemplary embodiment of the present disclosure.

FIG. 28 is a perspective view of an exemplary embodiment of a modular lighting system that includes three of the luminaires 100 that are connected to each other by various connectors including the inline connector 200, the end connector 300, the corner connector 400 and the three-way connector 500.

Figure 29:
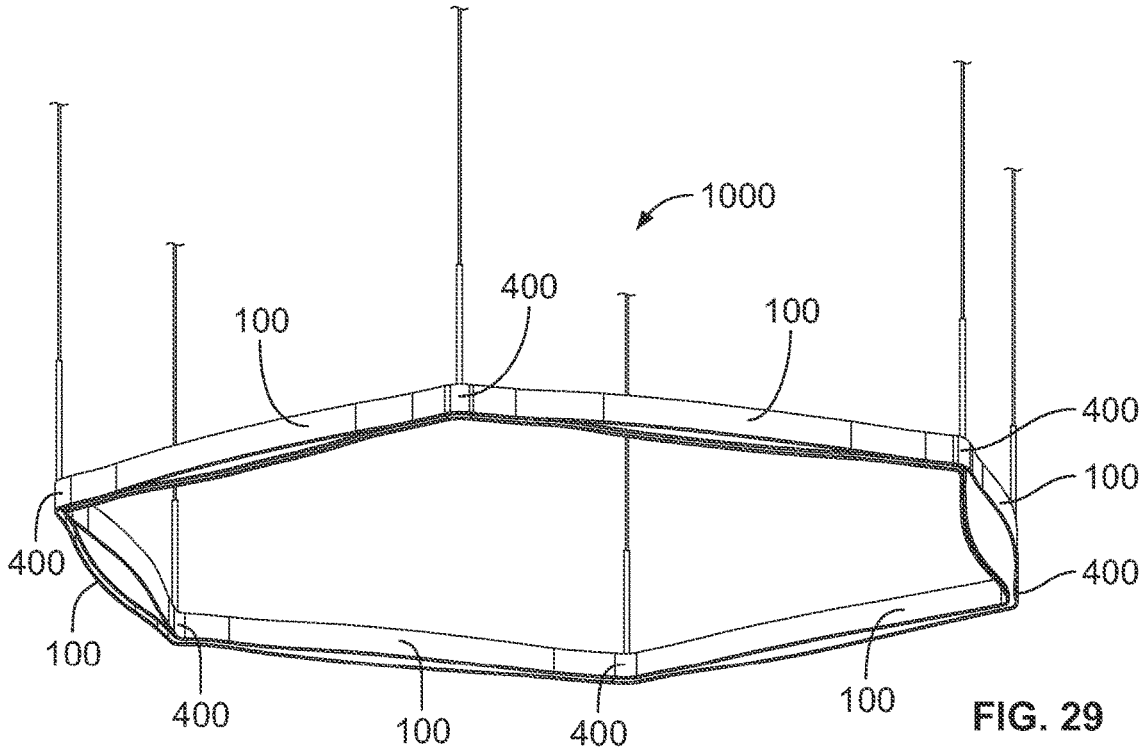
FIG. 29 is a perspective view of a modular lighting system that includes six of the luminaires of FIG. 1 that are connected to each other by the corner or hex connector of FIG. 19 to form a hexagon according to an exemplary embodiment of the present disclosure.

FIG. 29 is a perspective view of an exemplary embodiment of a modular lighting system that includes six of the luminaires 100 that are connected to each other by the corner or hex connector 400 to form a hexagon.

Figure 30:
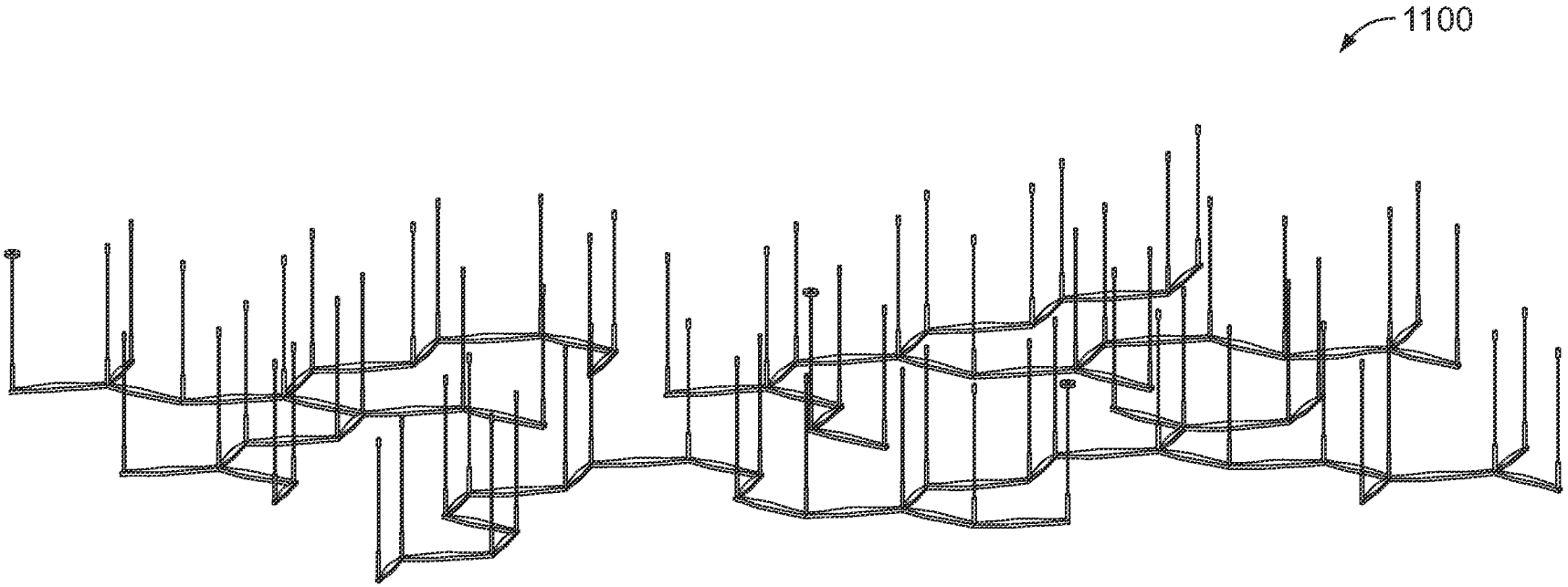
FIG. 30 is a perspective view of a modular lighting system that includes a plurality of the luminaires of FIG. 1 that are connected to each other by various connectors according to an exemplary embodiment of the present disclosure.

FIG. 30 is a perspective view of an exemplary embodiment of a modular lighting system that includes a plurality of the luminaires 100 that are connected to each other by various connectors.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claim is:

1. A lighting system, comprising:

a luminaire that includes a housing that has a first sidewall, a second sidewall that is spaced from the first sidewall, a light source arranged between the first sidewall and the second sidewall and a wire arranged within the luminaire that includes a first wire segment that is in contact with the light source and a second wire segment that bypasses and is not in contact with the light source, the first wire segment and the second wire segment being separated from each other at a first end of the wire and rejoining each other at a second end of the wire;

a first connector that is configured to be fixed to and delimit a first end of the luminaire and a second connector that is configured to be fixed to and delimit a second end of the luminaire, at least one of the first connector and the second connector are configured to transfer power to the wire arranged within the luminaire with one half of the positive current from the powcr source being directed by the first wire segment to light source and the other half of the positive current traveling over the second wire segment.

2. The lighting system of claim 1, wherein the luminaire includes a top plate that is arranged between the first sidewall and the second sidewall and a printed circuit board that is fixed to the top plate.

3. The lighting system of claim 1, further comprising at least one fastener that is configured to fix the printed circuit board to the top plate and transfer electrical current from the top plate to the circuit board.

4. The lighting system of claim 1, wherein the light source is fixed to the printed circuit board.

5. The lighting system of claim 1, wherein the light source is a plurality of light-emitting diodes.

6. The lighting system of claim 1, wherein the luminaire includes a diffuser that is spaced from the top plate and through which light from the light source projects.

7. The lighting system of claim 1, wherein each of the first sidewall and the second sidewall include a plurality of rails, openings and grooves that are configured to accommodate and aid in securing elements of the lighting system therein.

8. The lighting system of claim 1, further comprising a first bracket that include a first leg, a second leg and a base that extends between the legs, has an opening extending therethrorugh and is configured to be arranged at each end of the luminaire.

9. The lighting system of claim 8, further comprising a second bracket that includes a housing, an opening extending through the housing and a plug fixed to the opening of the housing that is arranged between the first leg and the second leg of the first bracket in an assembled state with the plug extending toward the opening of the base of the first bracket at each end of the luminaire in contact with the first bracket.

10. The lighting system of claim 1, wherein the first connector and the second connector are one of an end connector that is configured to delimit the lighting system, an inline connector that is configured to connect two of the luminaires to each other, a corner connector that is configured to connect two of the luminaires to each other at an angle and a three-way connector that is configured to connect three of the luminaires to each other.

11. The lighting system of claim 1, further comprising a cable that extends from a power source and is fixed within one of the first connector and the second connector.

12. The lighting system of claim 11, wherein the cable includes an inner wire over which positive current is transferred and an outer wire over which a negative current is transferred.

13. The lighting system of claim 12, wherein the negative current is in contact with at least one of the first connector and the second connector and over the at least one of the first connector and the second connector negative current travels and the positive current is in connect with at least one pin that extends from the at least one of the first connector and the second connector.

14. The lighting system of claim 9, wherein, in an assembled state, the at least one pin is arranged within the plug which in turn is in contact with a wire to transfer positive current therefrom.

15. The lighting system of claim 14, wherein the first wire segment is fixed to the printed circuit board to transfer positive current to the light source and the second wire segment that bypasses the printed circuit board.

16. The lighting system of claim 15, wherein the first wire segment is fixed to a first end of the printed circuit board and a second end of the first wire segment is fixed to a second end of the printed circuit board and extends to reconnect with the second wire segment at a second end of the luminaire.

17. A method of assembling a lighting system comprising the steps of:

providing a luminaire that includes a housing that has a first sidewall, a second sidewall that is spaced from the first sidewall, a light source arranged between the first sidewall and the second sidewall and a wire arranged within the luminaire that includes a first wire segment that is in contact with the light source and a second wire segment that bypasses and is not in contact with the light source, the first wire segment and the second wire segment being separated from each other at a first end of the wire and rejoining each other at a second end of the wire;

fixing a first connector to a first end of the luminaire;

fixing a second connector to a second end of the luminaire; and providing power through one of the first connector and the second connector to illuminate the light source with at least one of the first connector and the second connector configured to transfer power to the wire arranged within the luminaire with one half of the positive current from the power source being directed by the first wire segment to light source and the other half of the positive current traveling over the second wire segment.

18. The method of claim 17, wherein the luminaire includes a pin and a plurality of brackets extending at each end therefrom and the first connector and the second connector include opening therein and the method further comprises the step of arranging the brackets within the openings of the first connector and the second connector and fixing the luminaire to the first connector and the second connector.

19. The method of claim 17, further comprising the step of transferring power from the one of the first connector and the second connector to the luminaire with negative current transferred through and about the one of the first connector and the second connector and positive current transferred through the pin of one of the first connector and the second connector the wire to illuminate the light source.

* * * * *